US007107959B2

(12) United States Patent
Kino et al.

(10) Patent No.: US 7,107,959 B2
(45) **Date of Patent: *Sep. 19, 2006**

(54) AIR INTAKE APPARATUS

(75) Inventors: Hitoshi Kino, Aichi (JP); Takahiro Komori, Aichi (JP); Yutaka Ogasawara, Aichi (JP); Tomoyuki Sawatari, Aichi (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/438,935

(22) Filed: May 16, 2003

(65) Prior Publication Data

US 2004/0065288 A1 Apr. 8, 2004

(30) Foreign Application Priority Data

May 16, 2002 (JP) ..... P2002-141978
Jul. 9, 2002 (JP) ..... P2002-200361

(51) Int. Cl.
*F02M 35/03* (2006.01)
*F02M 35/10* (2006.01)

(52) U.S. Cl. ..... 123/184.57; 181/204

(58) Field of Classification Search ..... 123/184.57; 181/201, 204; 55/185.3, 486–487, 385.3
See application file for complete search history.

(56) References Cited

U.S. PATENT DOCUMENTS 6,155,224 A * 12/2000 Akihisa et al. ..... 123/184.57
6,205,968 B1 * 3/2001 Spannbauer ..... 123/184.57
6,494,290 B1 * 12/2002 Jessberger ..... 181/250
6,517,595 B1 * 2/2003 Ishihara et al. ..... 55/385.3
6,530,984 B1 * 3/2003 Stuart ..... 96/380
6,622,680 B1 * 9/2003 Kino et al. ..... 123/184.21
6,629,425 B1 * 10/2003 Vaiyapuri ..... 62/259.2
6,705,267 B1 * 3/2004 Westerbeke et al. ... 123/184.53
2003/0062013 A1 4/2003 Kino et al.

FOREIGN PATENT DOCUMENTS

JP A-2002-21660 1/2002

OTHER PUBLICATIONS

Hirose et al., "Development of low noise intake system with unreflective duct (Part 2)", No. 10–00, ISSN 0919–1364, May 24, 2000, pp. 5–8 (Discussed on pp. 4–5 of the specification).

* cited by examiner

*Primary Examiner*—Marguerite McMahon
(74) *Attorney, Agent, or Firm*—Posz Law Group, PLC

(57) ABSTRACT

An air intake apparatus has an air intake port opening outside, and an air intake path communicating the air intake port with a combustion chamber of an engine. For suppressing noise getting out from the air intake port, with respect to walls partitioning the air intake path, an opening is provided at a part of said walls corresponding to an antinode region of resonance mode of standing wave in a full length of the intake path, or at a part of noise pressure level being high in the intake path. The opening is closed with a permeable member and a noise insulating wall is disposed outside the permeable member for suppressing emission of transmitting noise passing through the permeable member. member. Alternatively, a vibration control member for suppressing face-vibration of the permeable member and reducing radiant noise from the permeable member is provided instead of the noise insulating wall.

4 Claims, 21 Drawing Sheets

AIR INTAKE APPARATUS

The present application is based on Japanese Patent Applications Nos. 2002-141978 and 2002-200361, which are incorporated herein by reference.

BACKGROUND OF THE INVENTION

1. Field of the Invention

The present invention relates to an air intake apparatus for supplying an air to an engine, and in particular to an air intake apparatus enabling to suppress air suction noise. The present invention also relates to an air cleaner for filtering a sucked air to be led to an engine.

2. Description of the Related Art

A schematic view of the air intake apparatus is shown in FIG. 19. As seen in the same, the air intake apparatus 100 comprises an air intake duct 101, a resonator 110, an air cleaner 103, an air cleaner hose 104, a throttle body 105, and an intake manifold 106. In the intake apparatus 100, there occurs a problem about noises (called as "air suction noise" hereafter) getting out from an air intake port 102 of the intake duct 101.

FIG. 20 shows frequency distributions of suction noises without disposing the resonator 110 and a throttled part 111. As seen, the suction noise has plural resonance peaks. Of these plural resonance peaks, for example, a resonance peak A around 160 Hz is caused by a primary resonance mode of the intake duct 101. A peak B around 320 Hz is caused by a secondary resonance mode of the intake duct 101. A peak C around 260 Hz is caused by the primary resonance mode of the air cleaner hose 104. The resonance peaks above 150 Hz are caused by members respectively composing the intake apparatus 100. Accordingly, if changing length of paths of the respective members, the resonance peaks maybe comparatively easily adjusted. Therefore, the resonator 110 small in capacity may be adopted for lowering the resonance peaks existing in middle and high frequency ranges.

However, more noise reduction has been required over the whole range of the frequency of the noise to improve amenities of the inside of the car.

Further, a resonance peak D named as so-called low frequency heavy noise is not caused by each of members composing the intake apparatus 100. The resonance peak D is caused in the full length of the intake path 107 from the intake port 102 to the intake manifold 106. The intake apparatus 100 takes a pipe passage of one-side closed end where the intake port 102 is an opening end, while an intake valve (not shown) partitioning the intake manifold 106 and a combustion chamber 109 otherwise an upper face of a piston, are a closing end. Thus, the resonance peak D in the low frequency range is caused in the full length of the intake path 107. If the frequency of the resonance peak D agrees with an air pulsation transmitted from the side of the engine, the air suction noise radiated from the intake port 102 is made large. It is therefore difficult to lower the resonance peak D, that is, to suppress the low frequency heavy noise.

For suppressing the low frequency heavy noise, the intake duct 101 or the air cleaner 103 of the intake apparatus 100 is arranged with the resonator 110 of comparatively large capacity as around $2\times10^{-3}$ to $10^{-2}$ $m^3$.

There is often a case that a throttled part 111 is often arranged together with the resonator 110 of large capacity nearly the intake port 102 of the intake duct 101 for increasing acoustic mass and decreasing the air sucking noise.

But, as mentioned above, the resonator 110 for controlling the low frequency heavy noise is comparatively large in the capacity, and a whole of the intake apparatus 100 is made large accordingly, so that spaces for mounting other devices than the intake apparatus 100 are made narrow.

If the area of the intake path is throttled by the throttled part 111, an air flowrate to be supplied to the combustion chamber 109 decreases. In particular, when the engine rotates at high speed, a desired air flow rate is not effected, and an engine output goes down.

SUMMARY OF THE INVENTION

It is accordingly an object of the invention to provide such an air intake apparatus capable of being reduced in size, securing the desired engine output, and suppressing the noise.

(1) For solving the above problems, the air intake apparatus of the invention comprises the air intake port opening outside, and the air intake path communicating the air intake port with the combustion chamber of an engine, and is characterized in that, for suppressing noise getting out from the air intake port, with respect to walls partitioning the air intake path, an opening is provided at the part of said walls corresponding to an antinode region of resonance mode of standing wave in the full length of the intake path, or at the part of noise pressure level being high in the intake path, and said opening is closed with a permeable member and a noise insulating wall is disposed outside the permeable member for suppressing emission of transmitting noise passing through the permeable member.

In short, the air intake apparatus of the invention is provided with the opening at the part of the walls corresponding to the antinode of resonance mode, or at the part of noise pressure level being high in the intake path, and this opening is closed with the permeable member. See Unexamined Japanese Patent Publication No. 2002-21660 and "Development of low noise intake system with unreflective duct (Part 2)" published on May 24, 2000 regarding the antinode of resonance mode and noise pressure level in the air intake apparatus.

With the permeable member disposed, the inner pressure of the intake path is released outside from the interior of the intake apparatus via the permeable member, so that a standing wave is thereby suppressed from occurrence. The permeable member has lots of fine pores, and energy of noise wave entering the fine pores is converted into heat energy owing to viscous friction between the air and a wall of the fine pole, so that it is possible to effectively reduce noises (called as "air transmitting noise" hereafter) getting out from the intake path to the outside of the permeable member by air transmission loss. By these actuations, depending on the intake apparatus of the invention, the noise from the intake port may be suppressed.

Further, by the air intake apparatus of the invention, any resonator of large capacity is unnecessary or it becomes possible to reduce the capacity of the resonator. Accordingly, the whole of the intake apparatus may be reduced in size. Disposing the resonator, noise having frequency around the noise demanded to be controlled might be in turn increased by anti-resonance. So, it is necessary to carry out a tuning of the capacity of the resonator. On the other hand, since the air intake apparatus of the invention suppresses the noise by the permeable member, there is no possibility to cause anti-resonance. Accordingly, by the intake apparatus of the invention, it is unnecessary to carry out the tuning for suppression of anti-resonance.

According to the intake apparatus of the invention, it would be possible to reduce the noise even in the case where the throttle part is not formed in the intake duct. Accordingly, the air flow rate for the combustion chamber does not go down, and the desired engine output can be easily secured.

The intake apparatus of the invention is furnished with a noise insulating wall outside of the permeable member for suppressing emission of the air transmitting noise passing through the permeable member. For reducing the sucking noise, the air transmitting noise is made large, but not only the air sucking noise but the air transmitting noise cause noises.

In this regard, the intake apparatus of the invention has the noise insulating wall outside of the permeable member for blocking the transmitting noise having passed through the permeable member from further getting out outside. Accordingly, by the intake apparatus of the invention, not only the sucking noise but the transmitting noise can be controlled. In addition, it is possible to prevent reduction of permeability due to adhering of moisture, foreign materials, or the like to the permeable member according to the intake apparatus of the invention. Accordingly, noise reduction effect can be maintained in the long term.

Furthermore, according to the intake apparatus of the invention, so-called low frequency heavy noise, which is not caused by each of members composing the intake apparatus, may be easily suppressed.

(2) The resonance frequency of said noise is 200 Hz or lower in general. The noise having the resonance peak in this frequency range is especially rasping. By the present structure, this rasping noise can be concentrically suppressed.

(3) In case there is present, in the air cleaner, the part of the walls corresponding to the antinode region of the resonance mode of the standing wave in the full length of the intake path, or the part of noise pressure level being high in the intake path, it is enough to determine the opening is provided in the air cleaner.

In short, the present structure disposes the permeable member and the noise insulating wall in the air cleaner. The wall part of the air cleaner has many planes of face-structure in comparison with wall parts of other members forming the intake apparatus. Accordingly, following this structure, the opening can be comparatively easily provided, and the permeable member is easily and cheaply disposed.

Desirably, since the permeable member is clogged when the water or dusts invade into the air cleaner from the side of the intake duct, so that it is difficult to release the air sucking pulsation pressure from the inside to the outside, the reducing effect of the desired air sucking noise cannot be obtained, and an opening is provided at another wall part than the bottom wall of the air cleaner for arranging the permeable member there.

(4) In case there is present, in a clean side of the air cleaner, the part of the walls corresponding to the antinode region of the resonance mode of the standing wave in the full length of the intake path, or the part of noise pressure level being high in the intake path, it is enough to determine the opening is provided in the clean side of the air cleaner.

The air cleaner is divided by an air filter into an upstream side communicating with the intake port, i.e., a dirty side and a downstream side communicating with the combustion chamber, i.e., the clean side. The sucked air is filtered by passing through the air filter. In this structure, the permeable member and the noise insulating wall may be disposed at the clean side.

(5) In case there is present, in a dirty side of the air cleaner, the part of the walls corresponding to the antinode region of the resonance mode of the standing wave in the full length of the intake path, or the part of noise pressure level being high in the intake path, it is enough to determine the opening is provided in the dirty side of the air cleaner.

(6) In case there is present, in the air cleaner hose, the part of the walls corresponding to the antinode region of the resonance mode of the standing wave in the full length of the intake path, or the part of noise pressure level being high in the intake path, it is enough to determine the opening is provided at least in the air cleaner hose.

The structure disposes the permeable member and the noise insulating wall in the air cleaner hose. The air cleaner hose is disposed at the downstream side of the air cleaner.

(7) In case there is present, in an intake duct, the part of the walls corresponding to the antinode region of the resonance mode of the standing wave in the full length of the intake path, or the part of noise pressure level being high in the intake path, it is enough to determine the opening is provided in the part of the intake duct.

(8) The permeable member preferably has a water repellent property. Following this structure, it is possible to suppress the amount of the moisture entering the inside of the intake path through the permeable member.

(9) Desirably, it is sufficient that the noise insulating wall is structured to have a vibration control member for the noise insulating wall not to cause face-vibration of the permeable member owing to the transmitting noise from the permeable member. When the air transmitting noise reaches the noise insulating wall, the noise insulating wall itself probably generates the face-vibration by the air transmitting noise, and by this face-vibration, a new noise might be caused as a noise source becoming the noise insulating wall itself.

In this point, the noise insulating wall of this structure has the vibration control member for the noise insulating wall. Accordingly, following the structure, the noise insulating wall is less to make the face-vibration, and the noise insulating wall itself is difficult to generate noises.

(10) For solving the above problems, the air intake apparatus of the invention comprises an air intake port, and an air intake path communicating with the air intake port and the combustion chamber of an engine, and is characterized in that, for suppressing noise emitted from the air intake port, with respect to walls partitioning the air intake path, the opening is provided at the part of said walls corresponding to the antinode region of resonance mode of standing wave in the full length of the intake path, or at the part of noise pressure level being high in the intake path, and said opening is closed with the permeable member and has a noise insulating wall for insulating transmitting noise passing through the permeable member, and has vibration control members for suppressing face-vibration of the permeable member and reducing radiant noise from the permeable member.

In short, the air intake apparatus of the invention has the permeable member and the vibration control member. As mentioned above, for lowering the air sucking noise, the transmitting noise is made large. But if an area of disposing the permeable member is enlarged, the permeable member itself probably produces the face-vibration, and by this face-vibration, a new noise might be caused as a noise source being the noise insulating wall itself.

In this point, the air intake apparatus of the invention has the vibration control member for suppressing the face-vibration of the permeable member. According to this structure, even if an area of disposing the permeable member is enlarged, the permeable member is less to make the face-vibration. Therefore, new noises caused by the permeable member itself can be suppressed.

Further, an air cleaner, enabling to suppress not only air suction noises but also air transmitting noises and decrease the number of parts is provided according to the present invention.

(11) For settling the above problems, an air cleaner of the invention comprises a case, an element partitioning the case into a dirty side and a clean side, and a permeable member sectioning a compartment room in the case, and this is characterized in that a noise insulating wall part is formed as one body within the case, said noise insulating wall part being provided with communicating holes for communicating the compartment room with the outside of the case.

In short, the air cleaner of the invention supports the permeable member within the case, and unifies the noise insulating wall to the case wall. The compartment room is partitioned with the permeable member and sectioned within the case. That is, in the case, an exterior and an interior of the compartment room are partitioned by the permeable member. The noise insulating wall part is disposed outside of the compartment room and has communicating holes through which the compartment room communicates with the exterior of the case.

Sound pressure runs along a passage of the exterior of the compartment room→the permeable member→the interior of the compartment room→the noise insulating wall part (communicating holes)→the outside of the case, and gets out from the interior to the exterior of the case. During getting out, a major part of sound pressure having transmitted the permeable member collides against other parts than the communicating holes of the noise insulating wall part, namely, the wall part. By this collision, the air transmitting noise is not directly released outside of the case, but acoustic mass is increased by the communicating holes so that the air transmitting noise can be suppressed.

According to the air cleaner of the invention, not only the air suction noise but the air transmitting noise can be suppressed. Accordingly, in case a noise insulating property is low in a part of installing the air cleaner (e.g., engine room), if installing the air cleaner of the invention, the suppression is especially effective. A reason therefor is because the air cleaner of the invention itself has the high noise insulating property and does not depend on a noise insulating property of the part of installing the air cleaner.

According to the air cleaner of the invention, the noise insulating wall part is formed as one body with the case. Therefore, in comparison with a case of forming the noise insulating wall part independently of the case, constituting parts may be reduced in number, a production cost may be saved accordingly and attachment of the air cleaner is made easy.

(12) Desirably, the noise insulating wall part is arranged at the dirty side of the case. If arranging the noise insulating wall part at the dirty side, even if dusts invade within the case of the air cleaner through the noise insulating wall part and the permeable member, dusts are filtered through the element. Therefore, it is easy to suppress dusts invading from the clean side of the case into a downstream side.

DETAILED DESCRIPTION OF THE PREFERRED EMBODIMENTS

Further explanation will be made to embodiments of the air intake apparatus according to the invention.

(1) First Embodiment

Figure 1:
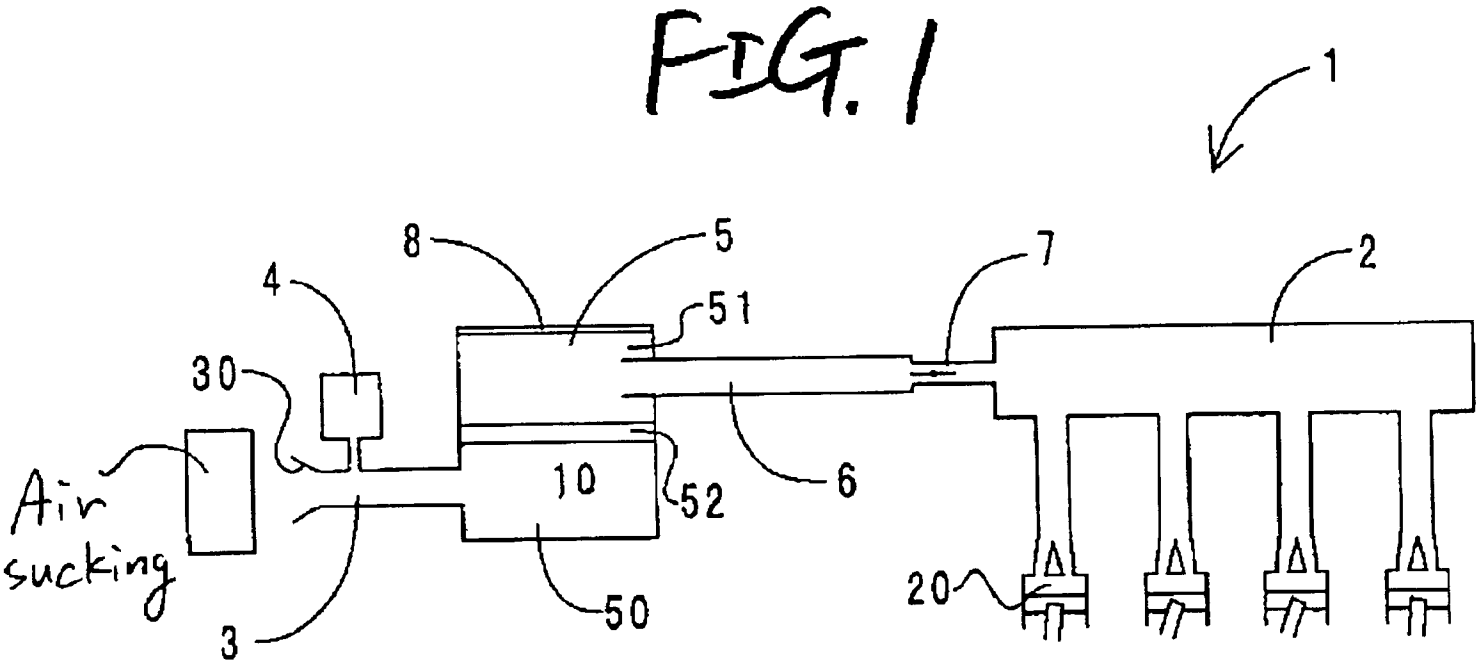
FIG. 1 shows a schematic view of the air intake apparatus based on the first embodiment of the invention.

At first, the structure of the embodied intake apparatus will be referred to. A schematic view of the air intake apparatus of the embodiment is shown in FIG. 1. As seen in the same, the air intake apparatus 1 comprises the air intake duct 3, the resonator 4 for middle and high frequencies, the air cleaner 5, the air cleaner hose 6, the throttle body 7, the intake manifold 2 and the permeable member 8. In the interior of these members, the air intake path 10 from the air intake port 30 to the intake manifold 2 is sectioned.

The intake duct 3 is made of a resin taking a cylindrical shape, and communicates with an outside of a vehicle via the intake port 30 provided at an upstream end. The resonator 4 for middle and high frequencies is generally made of the resin taking a box shape. The resonator 4 is branched and connected to the intake duct 3 at its middle part in this embodiment but it maybe located in other fashions within the air intake apparatus. A capacity, a shape or a communicating part with the intake duct 3 of the resonator 4 are effected with tuning for lowering the resonance peak in the middle and high frequencies of the air sucking noise.

Figure 2:
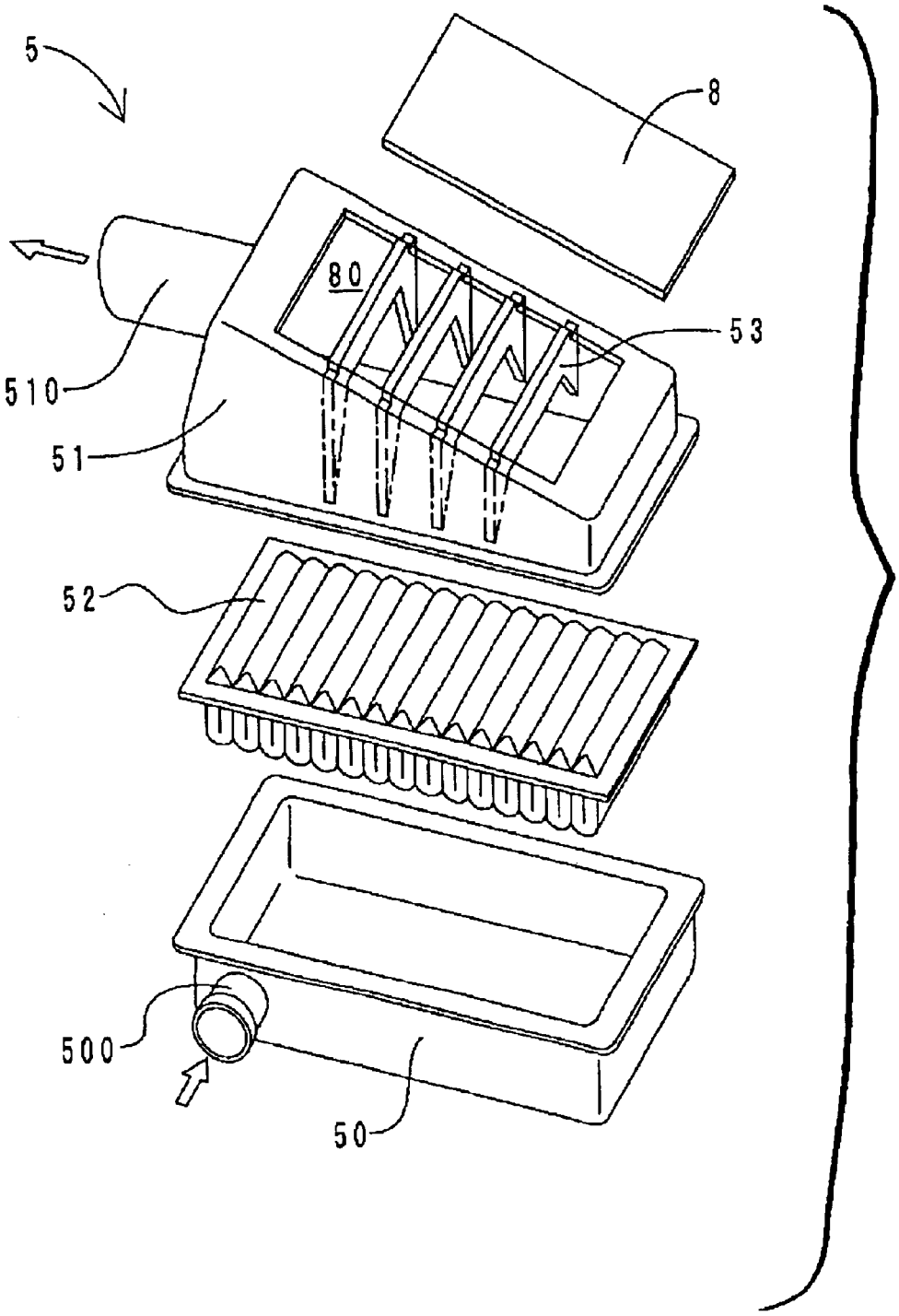
FIG. 2 shows a disassembled view of the air cleaner incorporated in the air intake apparatus based on the first embodiment of the same.

The air cleaner 5 has the dirty side case 50, the clean side case 51, and an element 52. FIG. 2 shows a disassembled view of the air cleaner. As shown in the same, the dirty side case 50 is made of the resin taking the box shape opening upward, and projects a duct connecting cylinder 500 from a side wall thereof, the duct connecting cylinder 500 being connected to the downstream end of the intake duct 3 shown in FIG. 1.

The clean side case 51 is made of the resin taking the box shape opening downward, mounted on the dirty side case 50 under a condition of turning over the opening, and projects a hose connecting cylinder 510 from a side wall 51 thereof. On an inside of the side wall of the clean side case 51 and an inside of an upper bottom wall, a plurality of U-shaped reinforcing ribs 53 stand following the insides. In the upper bottom wall of the clean side case 51, an oblong opening 80 is formed. A reason why the 80 is formed in the upper bottom wall of the clean side case 51 is because it has been proved by a preliminary simulation analysis that there is positioned an antinode region of the resonance secondary mode of the standing wave at one-side opening end. On the upper bottom wall of the clean side case 51 is included in the wall part of the invention. From the opening 80, the reinforcing ribs are seen in stripe.

The element 52 is a rectangular pleat-process PET non-woven fabric, secured between opening edges of the dirty side case 50 and the clean side case 51 and partitions a closed space defined between the dirty side case 50 and the clean side case 51 into upper and lower chambers.

The permeable member 8 is the PET non-woven fabric taking the rectangular shape. The permeable member 8 may be a woven fabric, a PP non-woven fabric, or the like as far as being permeable. The permeable member 8 closes the opening 80 under a condition that it is supported from the lower part by the reinforcing ribs. The reinforcing ribs 53 are included in the vibration control member of the invention. The permeable member 8 is secured to a periphery of the opening 80 and the reinforcing ribs 53 by known means such as inserting or fusing.

Turning to FIG. 1, the air cleaner hose 6 is made of rubber or resin taking a bellows cylinder, and is connected at its upstream end to the resin-made hose connecting cylinder 510 shown in FIG. 2. The air cleaner hose 6 is connected at its downstream end to the upstream end of the throttle body 7 which is connected at its downstream end to the intake manifold 2 branched to the combustion chamber. The air sucked from the outside passes in order of the intake duct 3→the dirty side case 50→the element 52→the clean side case 51→the air cleaner hose 6→the throttle body 7→the intake manifold 2, and goes into the combustion chamber 20.

Figure 3:
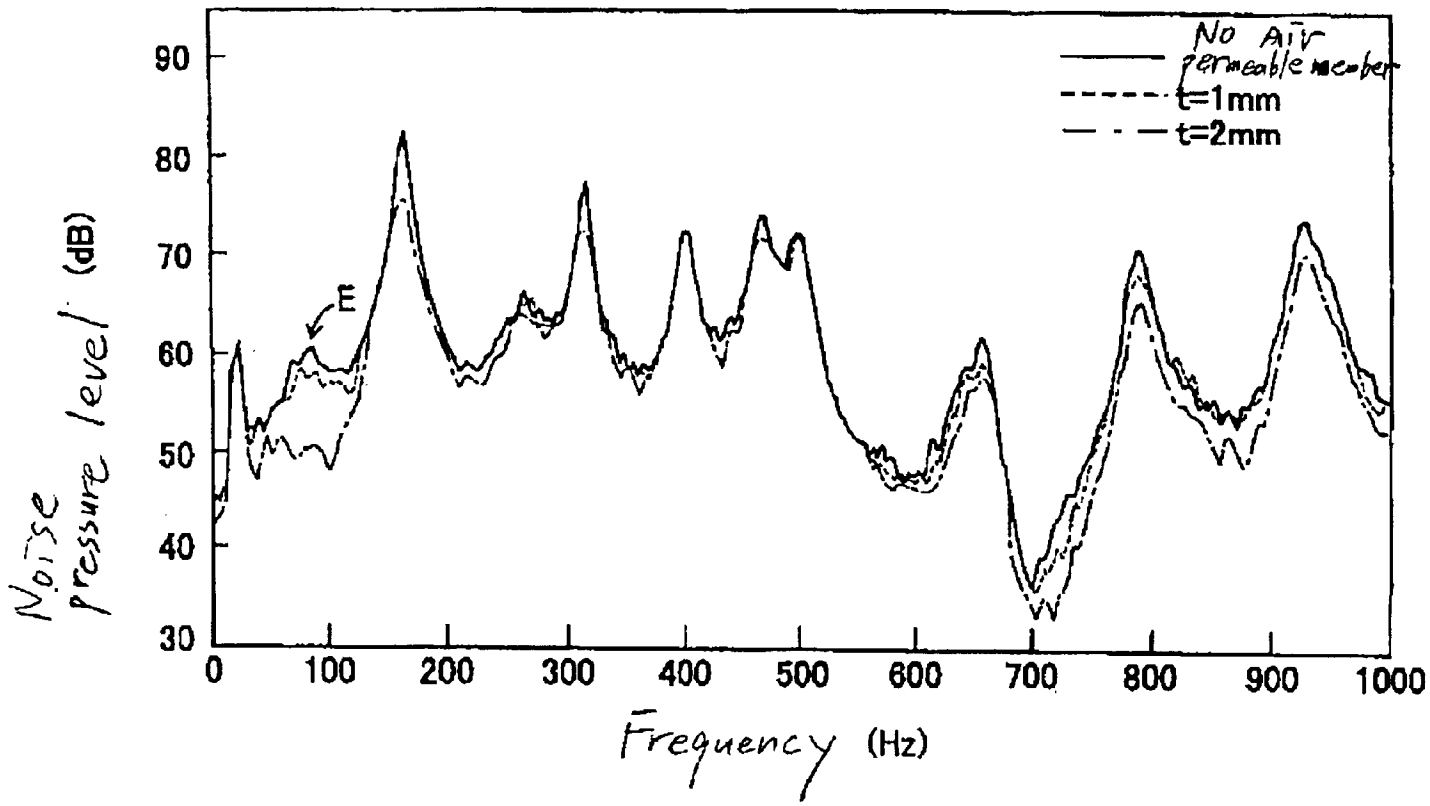
FIG. 3 shows a graph showing the frequency distributions of the air sucking noises of the air intake apparatus based on the first embodiment.

Next, effects brought about by the air intake apparatus 1 of the embodiment will be referred to. FIG. 3 shows the frequency distributions without disposing the resonator 4 for the middle and high frequencies and the reinforcing ribs 53. By the way, the frequency distributions were measured by generating white noises from a speaker placed at the downstream of the intake manifold 2 and collecting the air sucking noise. In the figure, a solid line is the frequency distribution without the permeable member shown in FIG. 14. In the same, a dotted line is the frequency distribution with the permeable member of thickness t=1 mm. One-dotted line is the frequency distribution with the permeable member of thickness t=2 mm. In regard to the permeable member, the PET non-woven fabric of raw fabric weight being 840/$m^2$ and the PET non-woven fabric of raw fabric thickness (before a hot-pressing) being 5 mm are subjected to the hot press to change thickness for changing quantity of airflow.

As shown, if disposing the permeable member, the resonance peak E of the low frequency heavy noise goes down. Practically, in case of t=1 mm, the resonance peak E lowers by about 3 dB, while in case of t=2 mm, it lowers by about 10 dB. In view of the resonance peak decreasing effect by the resonator being about 5 dB to 10 dB, it is seen that the permeable member has a substantially equivalent resonance peak decreasing effect to that of the resonator. From the fact that the decreasing rate of the resonance peak E is larger in t=2 mm than t=1 mm, it is seen that the larger is the thickness of the permeable member, the lower is the density, the larger is the resonance peak decreasing effect in sucking noise. Hereupon, by suppressing the compression amount of the raw member for the permeable member during the manufacturing process of the permeable member, the density of the permeable member can be lowered and its permeability is made higher. Further, it is seen that the resonance peak decreasing effect is large in the low frequency range of in particular more than 30 Hz to less than 150 Hz.

According to the intake apparatus 1 of the embodiment, any resonator of large capacity is unnecessary or it becomes possible to reduce the capacity of the resonator. The whole of the intake apparatus 1 can be therefore reduced in size. Further, according to the permeable member 8 in the intake apparatus 1 of the embodiment, there is no possibility of causing anti-resonance. The noise can be therefore more easily suppressed. Depending on the intake apparatus 1 of the embodiment, the noise can be effectively controlled without placing the throttle in the air intake duct 3. The desired engine output can be easily therefore secured.

The intake apparatus 1 of the embodiment is furnished with the reinforcing ribs 53 as the vibration control member. Therefore, even if the area of the air passing is large in the permeable member 8, possibility of the permeable member 8 causing the face-vibration is scarce. The reinforcing ribs 53 may be formed of the same material as that of the clean side case 51, i.e., the air cleaner case, may be formed at the same time as forming the air cleaner case, and may be formed by inserting the permeable member 8 when forming the air cleaner case so as to unify the air cleaner case and the permeable member 8 and concurrently unify the permeable member 8 and the reinforcing ribs 53. In addition, the permeable member 8 of the embodied air intake apparatus 1 may be placed at the clean side of the air cleaner case.

(2) Second Embodiment

A difference of this embodiment from the first embodiment is that the noise insulating wall is arranged outside of the permeable member.

Figure 4:
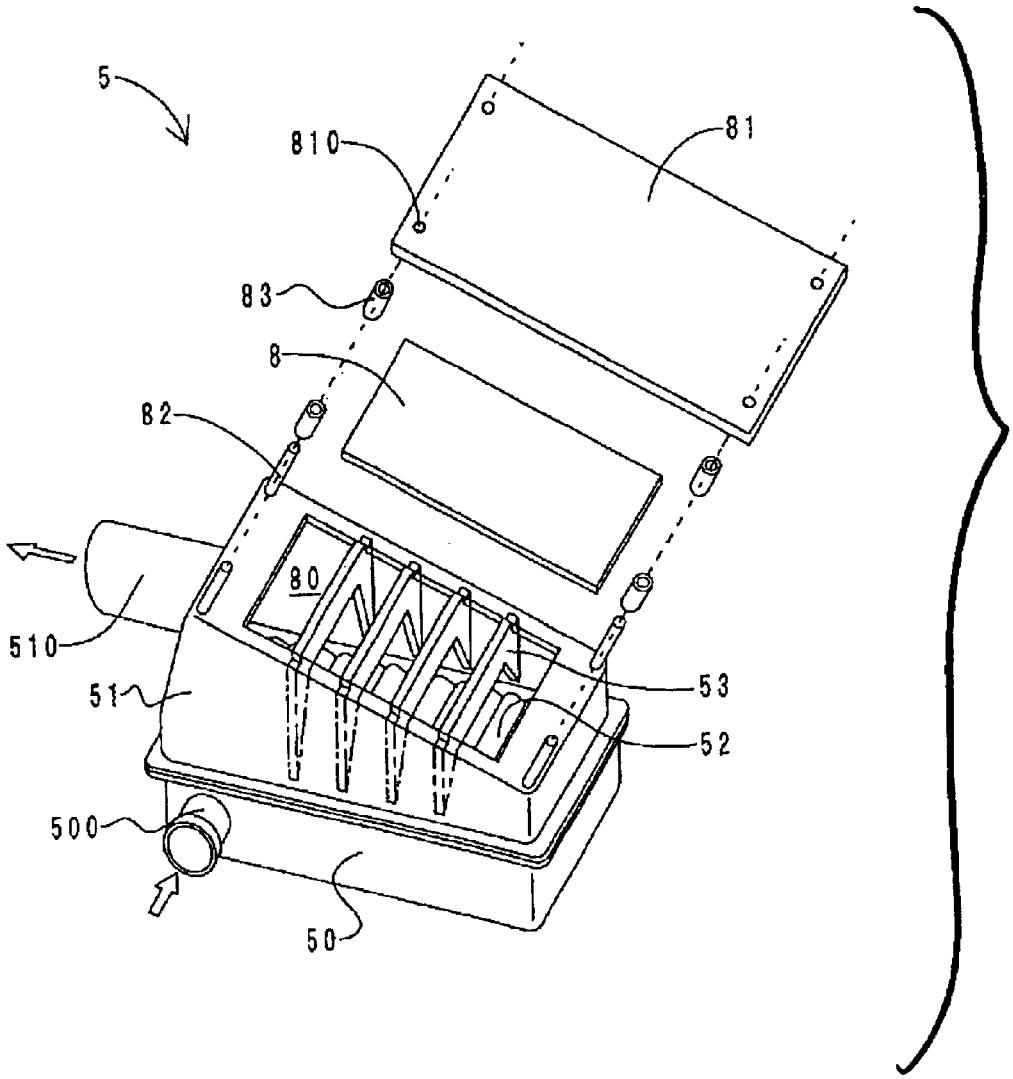
FIG. 4 shows a partially disassembled view of the air cleaner incorporated in the air intake apparatus based on the second embodiment.

At first, explanation will be made to a structural difference of the intake apparatus of this embodiment. FIG. 4 shows a partially disassembled view of the air cleaner incorporated in the air intake apparatus based on this embodiment. The same numerals will be given to parts corresponding to those of FIG. 2. As seen, the noise insulating wall 81 is made of the resin, taking the rectangular plate shape with pin holes 810 at four corners. On the other hand, pins 82 stand corresponding to the pin holes 810 from four corners in an outer surface of an upper bottom wall of the clean side case 51. The pins 82 are mounted thereon with resin-made spacers 83 shaped in cylinder, and fitted in the pin holes 810 via the cylindrical spacers 83.

Figure 5:
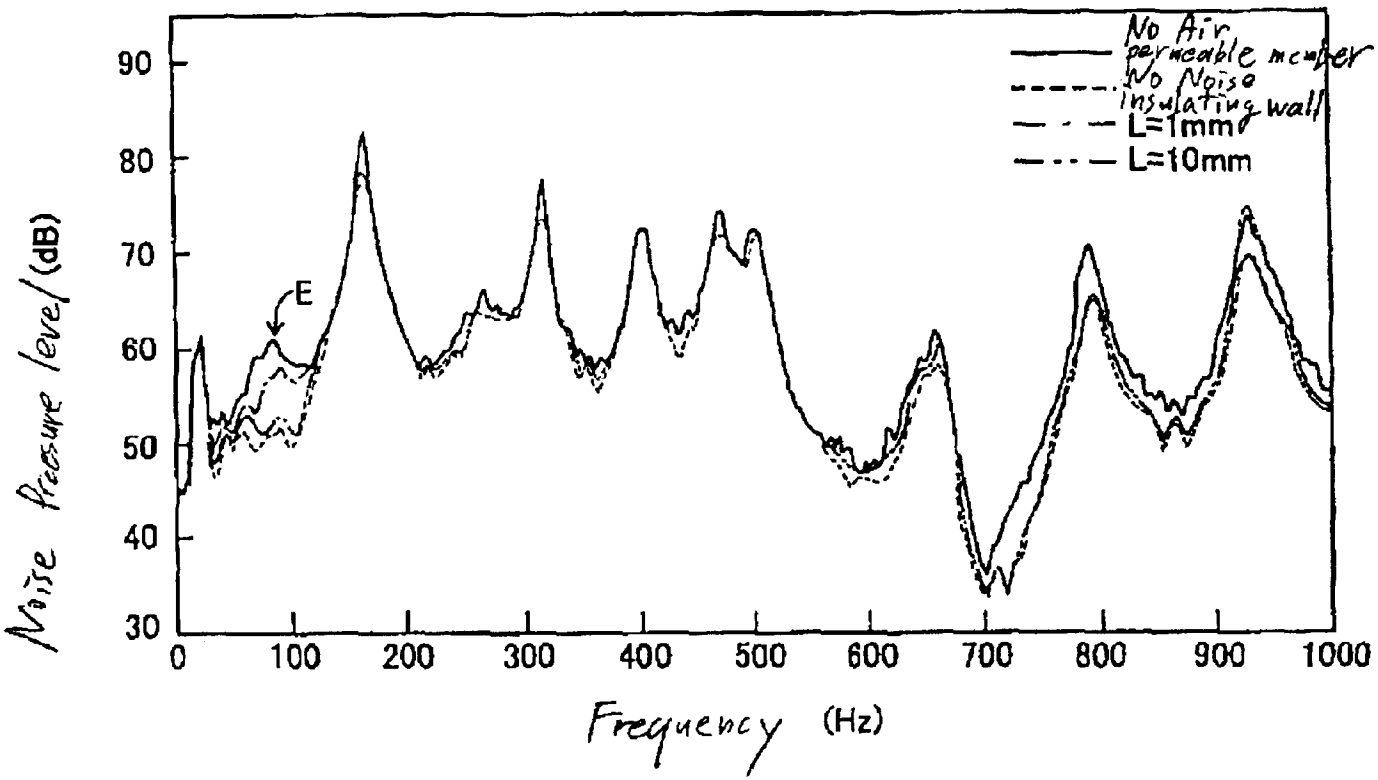
FIG. 5 shows a graph showing the frequency distributions of the air suction noises of the air intake apparatus based on the second embodiment.
Figure 20:
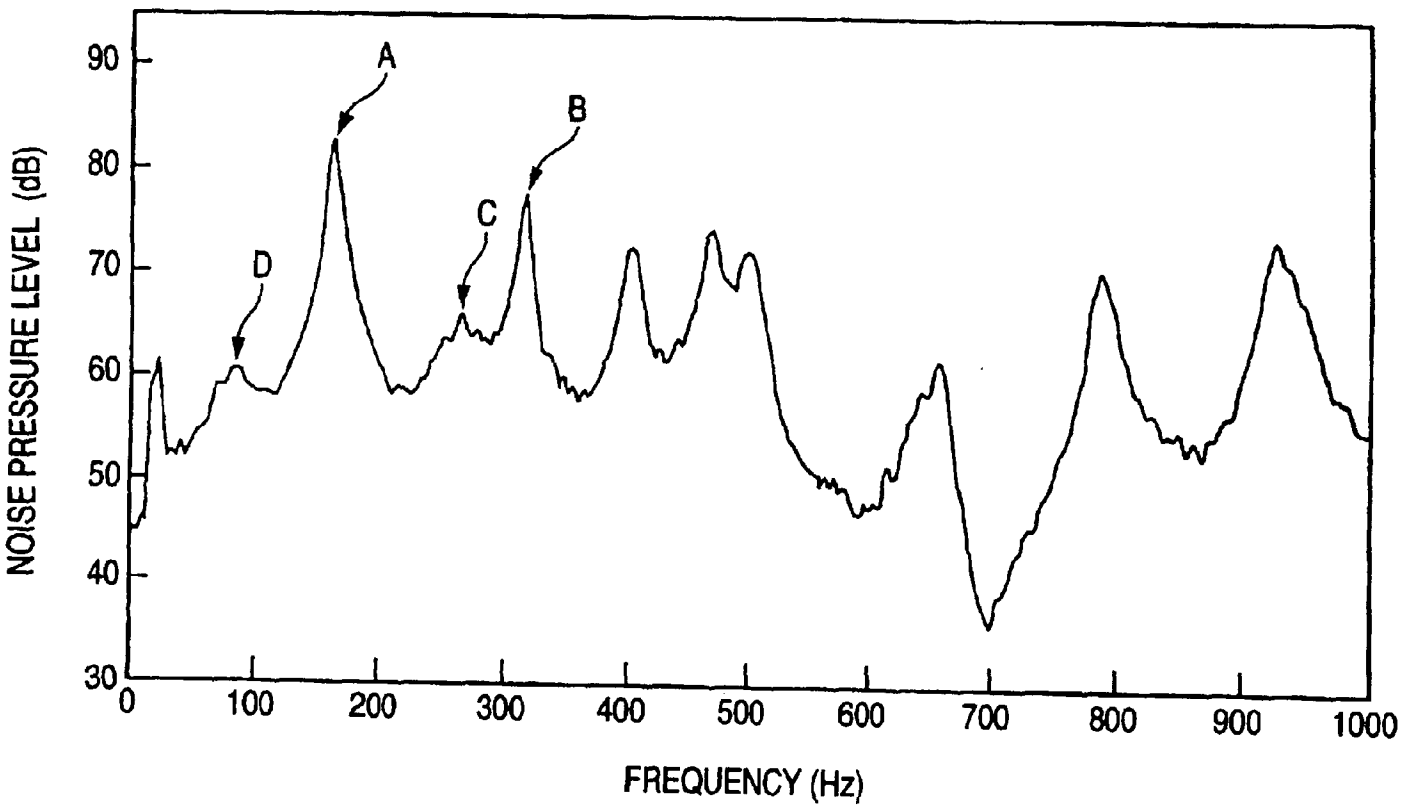
FIG. 20 shows a graph showing the frequency distributions of the air sucking noises of the conventional air intake apparatus.

Next, explanation will be made to different effects of this embodied air intake apparatus from those in the first embodiment. FIG. 5 shows the frequency distributions of the air suction noises without disposing hen the resonator 4 for middle and high frequencies. In the figure, the solid line is the frequency distribution without the permeable member shown in FIG. 20. In the same, the dotted line is the frequency distribution with the only permeable member of thickness t=2 mm and without the noise insulating wall. One-dotted line is the frequency distribution with the permeable member of thickness t=2 mm and the noise insulating wall arranged separated by a width L=1 mm from the permeable member. Two-dotted line is the frequency distribution with the permeable member of thickness t=2 mm and the noise insulating wall arranged separated by a width L=10 mm from the permeable member.

As shown, in the case of L=1 mm, comparing with a case of having the only permeable member and not having the noise insulating wall, the resonance peak E of the low frequency heavy noise is high. In the case of L=10 mm, comparing with the case of having the only permeable member and not having the noise insulating wall, the resonance peak E of the low frequency heavy noise is almost at the same height. From this fact, it is seen that the larger is the distance width L, the larger is the effect of reducing the air sucking noise.

Figure 6:
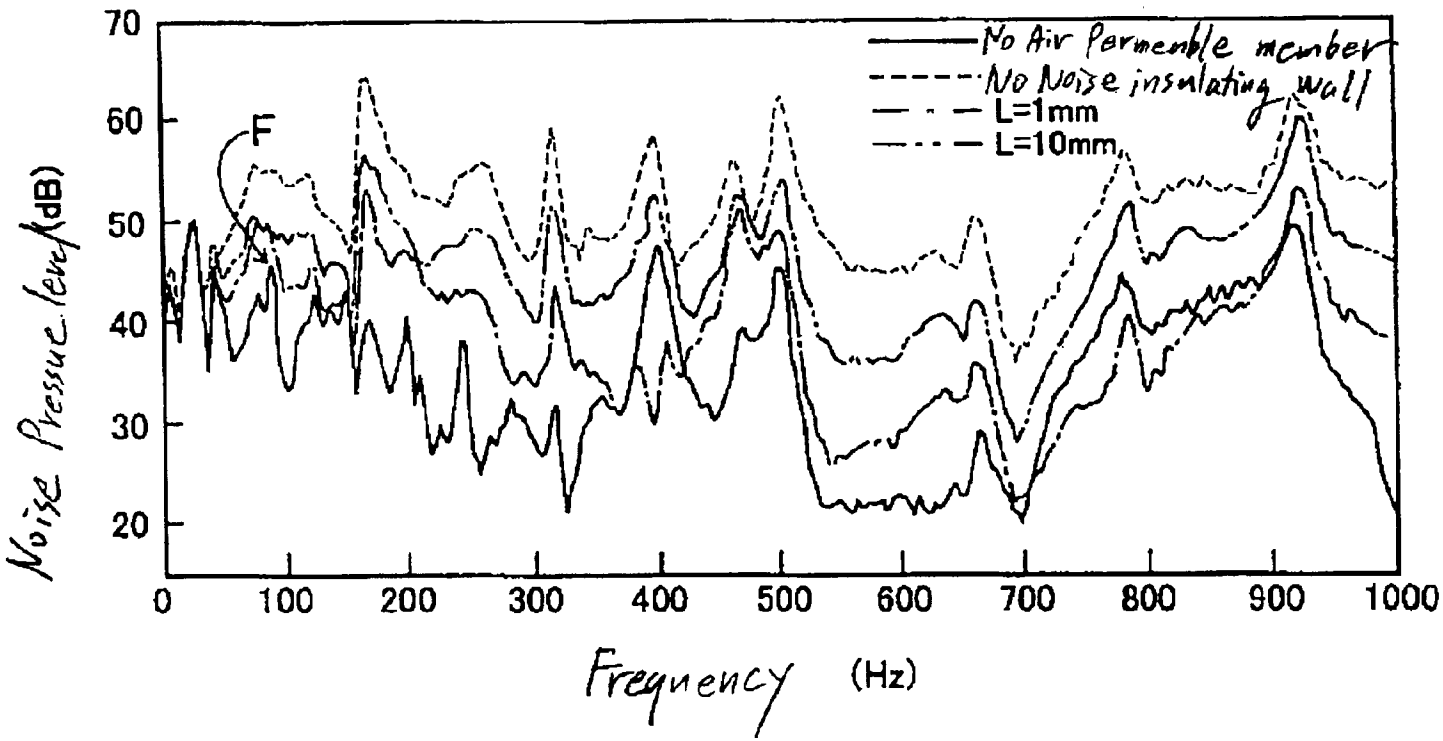
FIG. 6 shows a graph showing the frequency distributions of the air transmitting noises of the air intake apparatus based on the second embodiment.

FIG. 6 shows the frequency distributions of the air transmitting noises without arranging the resonator 4 for middle and high frequencies. The transmitting noise is collected by disposing the microphone outside of the noise insulating wall 81. In the figure, the solid line is the frequency distribution without the permeable member. In the same, a dotted line is the frequency distribution with the only permeable member of thickness t=2 mm and without the noise insulating wall. One-dotted line is the frequency distribution with the permeable member of thickness t=2 mm and the noise insulating wall arranged separated by a width L=1 mm from the permeable member. Two-dotted line is the frequency distribution with the permeable member of thickness t=2 mm and the noise insulating wall arranged separated by a width L=10 mm from the permeable member.

As shown, in the case of L=1 mm, comparing with a case of having the only permeable member and not having the noise insulating wall, the resonance peak F of the low frequency heavy noise is low by around 5 dB. In the case of L=10 mm, comparing with the case of having the only permeable member and not having the noise insulating wall, the resonance peak F of the low frequency heavy noise is low by around 5 dB. Only, in view of the whole of the frequency distributions, each of the resonance peaks is lower in L=1 mm than L=10 mm. From this fact, it is seen that the smaller is the distance width L, the larger is the effect of reducing the transmitting noise.

From FIGS. 5 and 6, it is seen that with the disposal of the noise insulating wall 81, almost equivalent effects of lowering the transmitting noise are brought about in comparison with the case of not disposing the noise insulating wall 81 but disposing the only permeable member 8. Further, it is seen that with the disposal of the noise insulating wall 81, large effects of lowering the transmitting noise are brought about in comparison with the case of not disposing the noise insulating wall 81 but disposing the permeable member 8 only. In addition, if changing the separating width L, it is seen that the air suction noise and the transmitting noise may be balanced.

Accordingly, depending on the air intake apparatus 1 of this embodiment, not only the air sucking noise but also the transmitting noise can be controlled. By changing the separating width L, the air sucking noise and the transmitting noise may be best balanced. That is, it is sufficient that the separating width L is set at an optimum value, taking, for example, noise interrupting property in the engine room or clog preventing effect of the permeable member into consideration. The noise insulating wall 81 itself may be a permeable member of lower permeability than that of the permeable member arranged in the air cleaner case.

(3) Third Embodiment

A difference of this embodiment from the second embodiment is that the permeable member and the noise insulating wall are arranged at the dirty side case. Therefore, this difference will be referred to herein.

Figure 7:
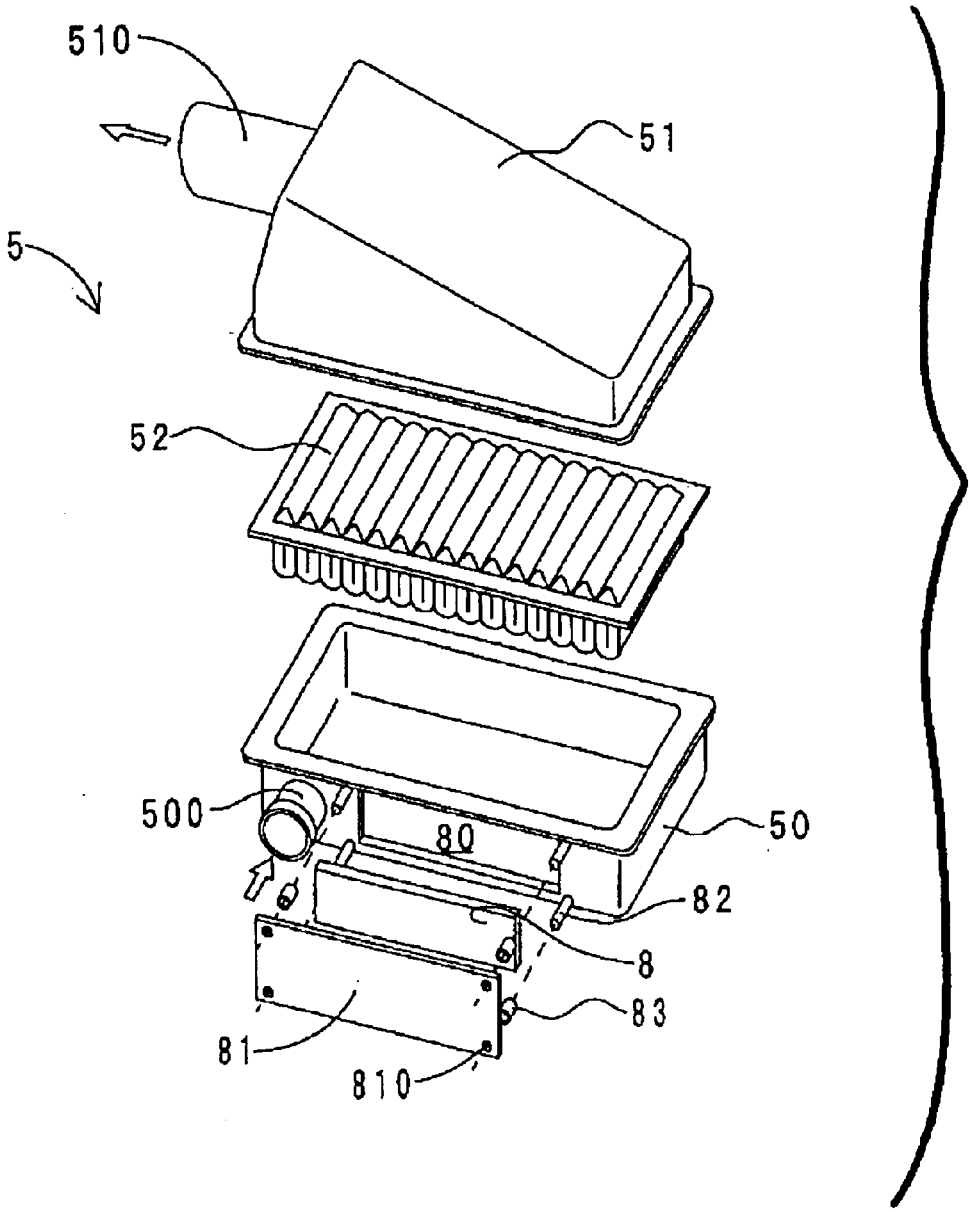
FIG. 7 shows a partially disassembled view of the air cleaner incorporated in the air intake apparatus based on the third embodiment.

At first, explanation will be made to a structural difference of the intake apparatus of this embodiment. FIG. 7 shows a disassembled view of the air cleaner incorporated in the air intake apparatus based on this embodiment. The same numerals will be given to parts corresponding to those of FIG. 4. As seen, the rectangular opening 80 is provided at the side wall of the dirty side case 50. The permeable member 8 closes the opening 80. The noise insulating wall 81 is disposed outside of the permeable member 8.

Figure 8:
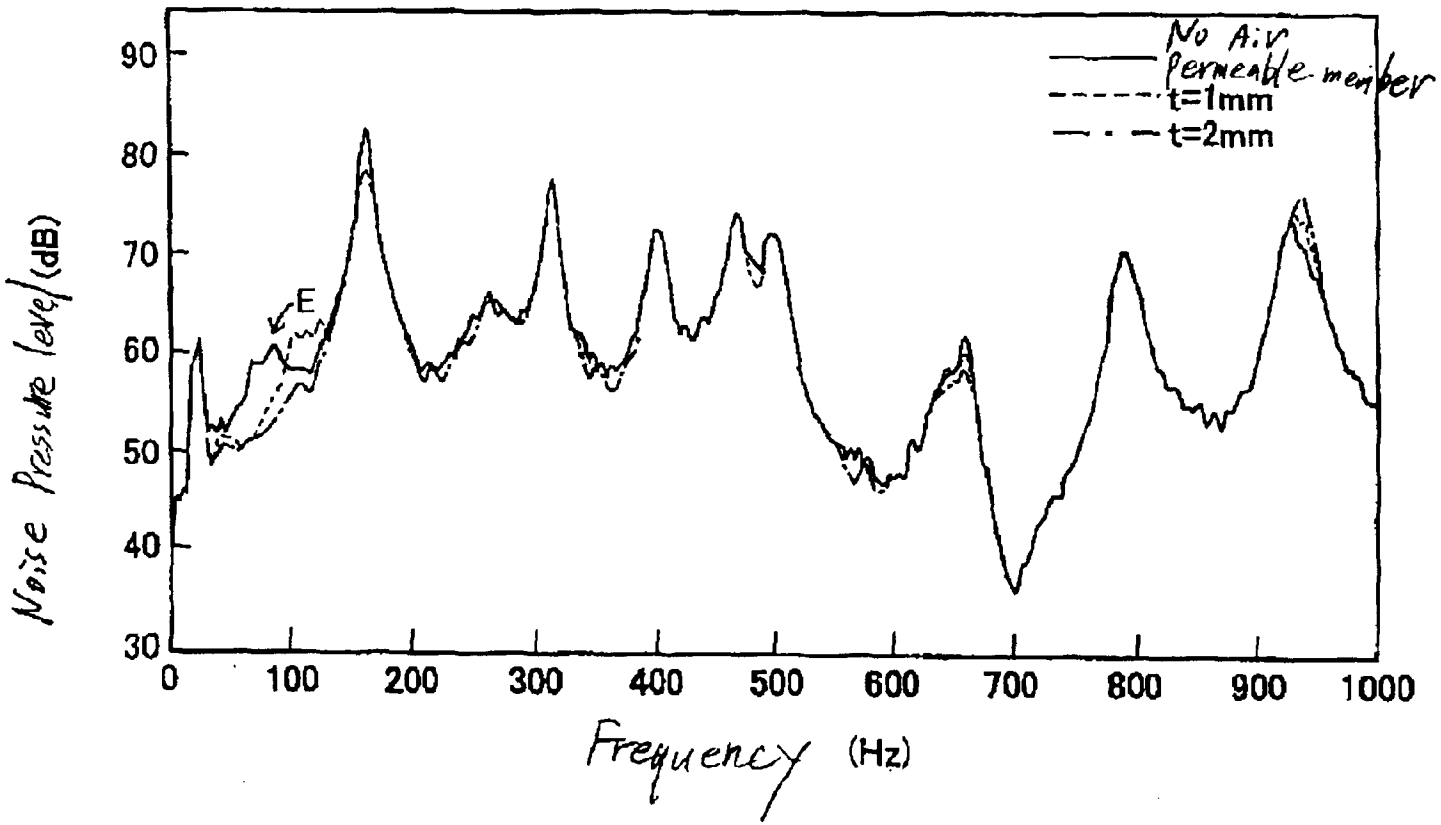
FIG. 8 shows a graph showing the frequency distributions of the air sucking noises of the air intake apparatus based on the third embodiment.

Next, explanation will be made to effects of this embodied intake apparatus. FIG. 8 shows the frequency distributions of the air sucking noises when the resonator 4 for middle and high frequencies is not disposed. In the figure, the solid line is the frequency distribution without the permeable member shown in FIG. 14. In the same, the dotted line is the frequency distribution with the permeable member of thickness t=1 mm. One-dotted line is the frequency distribution with the permeable member of thickness t=2 mm.

As shown, if disposing the permeable member, the resonance peak E of the low frequency heavy noise goes down. Practically, in case of t=1 mm, the resonance peak E lowers by about 5 dB, while in case of t=2 mm, it lowers by about 10 dB. From this fact, it is seen that the permeable member 8 has an almost equivalent effect of decreasing the resonance peak to that of the resonator. In view that the decreasing rate of the resonance peak E is larger in t=2 mm than t=1 mm, it is seen that the larger is the thickness of the permeable member, that is, the higher is the permeability of the permeable member, the larger is the resonance peak decreasing effect. Further, it is seen that the resonance peak decreasing effect is large in the low frequency range of in particular more than 30 Hz to less than 150 Hz. Also in the intake apparatus of this embodiment, the noise may be suppressed.

(4) Fourth Embodiment

A difference of this embodiment from the second embodiment is that the permeable member and the noise insulating wall are arranged in the vicinity of the downstream of the intake duct. Therefore, this difference will be referred to herein.

Figure 9:
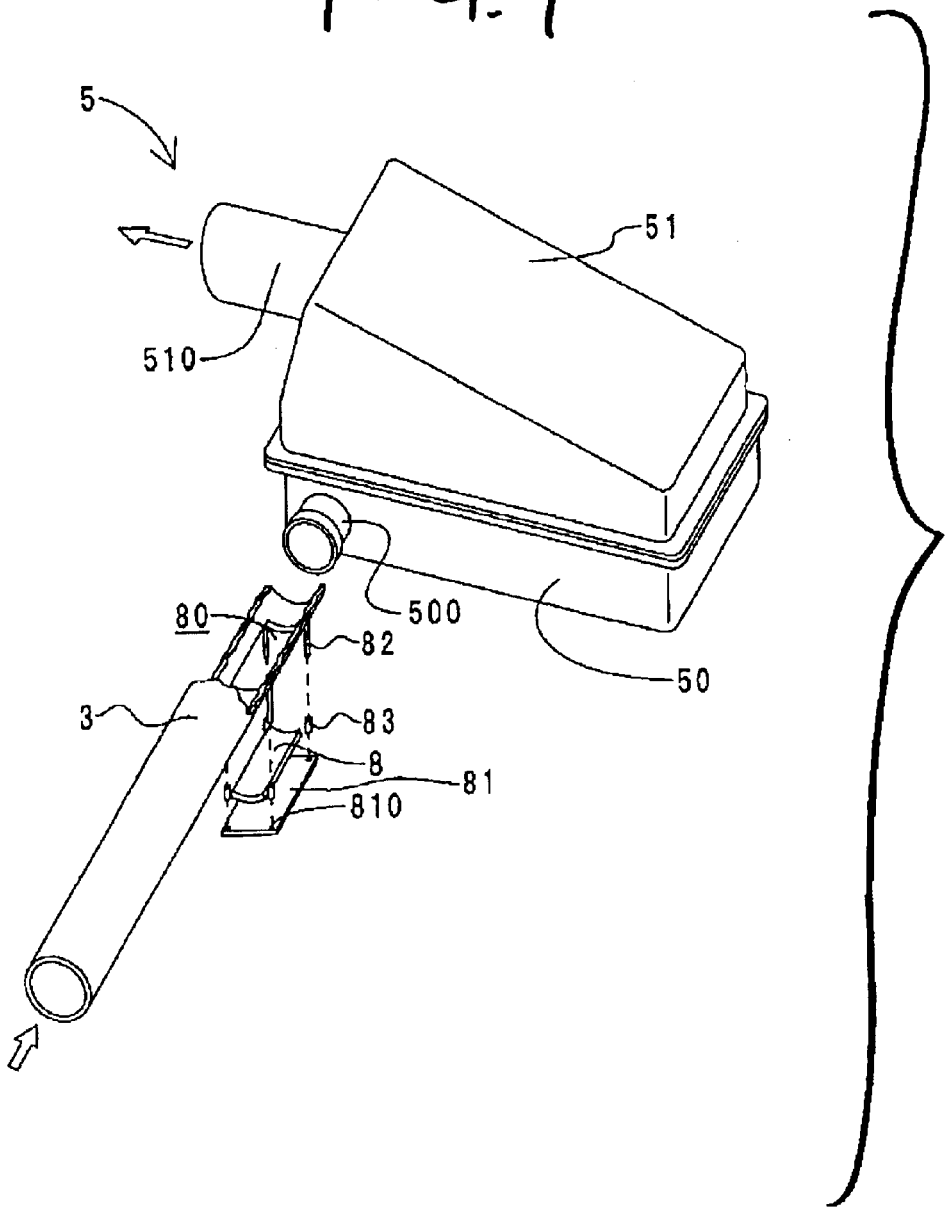
FIG. 9 shows disassembled views of the air intake duct and the air cleaner incorporated in the air intake apparatus based on the fourth embodiment.

At first, explanation will be made to a structural difference of the intake apparatus of this embodiment. FIG. 9 shows a disassembled view of the intake duct and the air cleaner incorporated in the air intake apparatus based on this embodiment. The same numerals will be given to parts corresponding to those of FIG. 4. As seen, the rectangular opening 80 is provided at the peripheral side wall of the intake duct 3. The permeable member 8 closes the opening 80. The noise insulating wall 81 is disposed outside of the permeable member 8.

Figure 10:
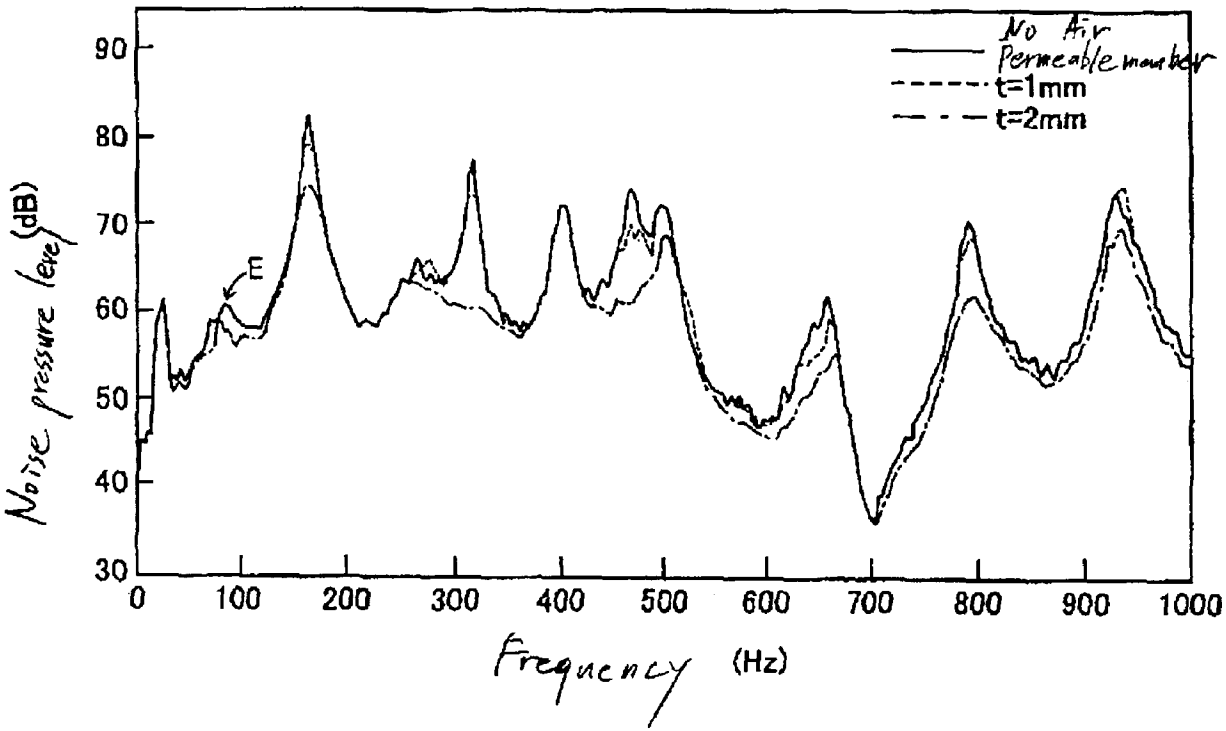
FIG. 10 shows a graph showing the frequency distributions of the air sucking noises of the air intake apparatus based on the fourth embodiment.

Next, explanation will be made to effects of this embodied intake apparatus. FIG. 10 shows the frequency distributions of the air suction noises when the resonator 4 for middle and high frequencies is not disposed. In the figure, the solid line is the frequency distribution without the permeable member shown in FIG. 14. In the same, the dotted line is the frequency distribution with the permeable member of thickness t=1 mm. One-dotted line is the frequency distribution with the permeable member of thickness t=2 mm.

As shown, it is seen that if disposing the permeable member, the resonance peak E of the low frequency heavy noise goes down. Further, the larger is the thickness of the permeable member, that is, the higher is the permeability of the permeable member, the larger is the resonance peak decreasing effect. Further, it is seen that the resonance peak decreasing effect is large in the low frequency range of in particular more than 30 Hz to less than 150 Hz. Also in the air intake apparatus of this embodiment, the noise may be suppressed.

(5) Fifth Embodiment

Differences of this embodiment from the second embodiment are that the noise insulating wall is shaped in cup, and the noise insulating wall is equipped with control ribs for the noise insulating wall. Therefore, the differences will be referred to herein.

Figure 11A:
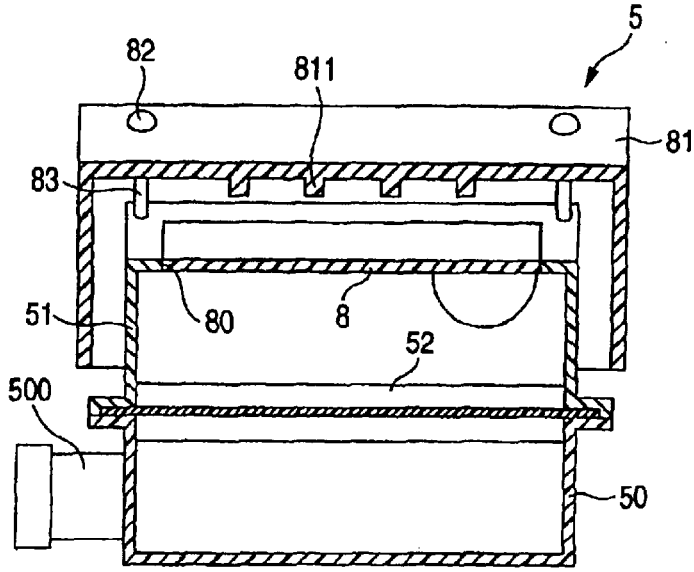
FIG. 11A shows a cross sectional view of the air cleaner incorporated in the air intake apparatus based on the fifth embodiment.
Figure 11B:
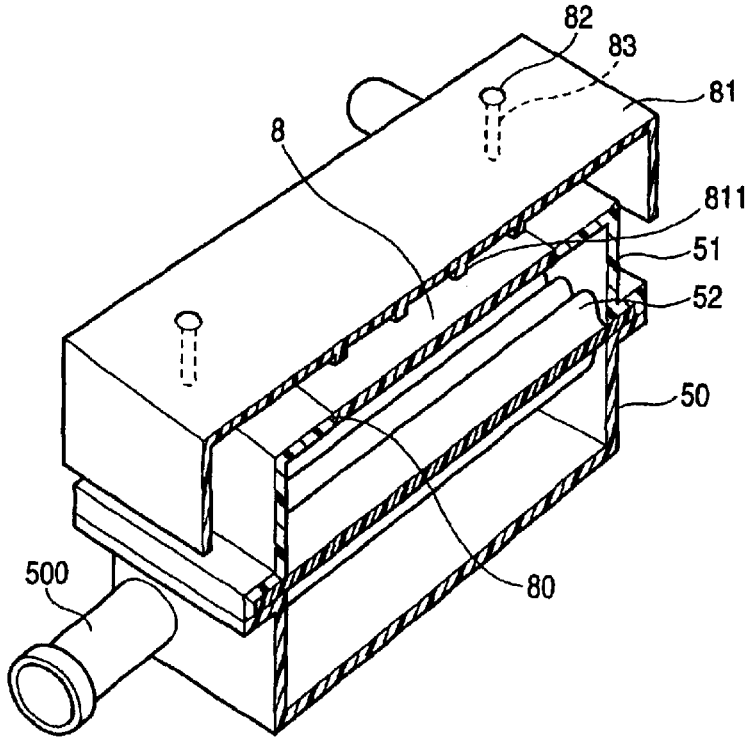
FIG. 11B shows a partial perspective view of the air cleaner based on the fifth embodiment.

FIG. 11A shows a cross sectional view of the air cleaner incorporated in the air intake apparatus based on this embodiment, and FIG. 11B shows a partial perspective view of the air cleaner of this embodiment. The same numerals will be given to parts corresponding to those of FIG. 4. As shown, the noise insulating wall 81 takes a cup shape opening toward the clean side case 51. Namely, the noise insulating wall 81 is arranged just as wrapping the permeable member 8. The control ribs 811 for the noise insulating wall stand on the lower face of the upper bottom wall of the noise insulating wall 81, and are included in the vibration control member for the noise insulating wall.

According to the embodiment, the noise insulating wall 81 is shaped in cup. Therefore, the noise insulating property is heightened. Further, the noise insulating wall 81 is equipped with control ribs 811 for the noise insulating wall. Thus, there is less possibility to generate noises by vibration of the noise insulating wall 81 itself.

(6) Sixth Embodiment

A difference of this embodiment from the fifth embodiment is that non-woven fabric layer is disposed on the inside of the cup of the noise insulating wall in substitution for the vibration ribs for the noise insulating wall. Therefore, the difference will be referred to herein.

Figure 12:
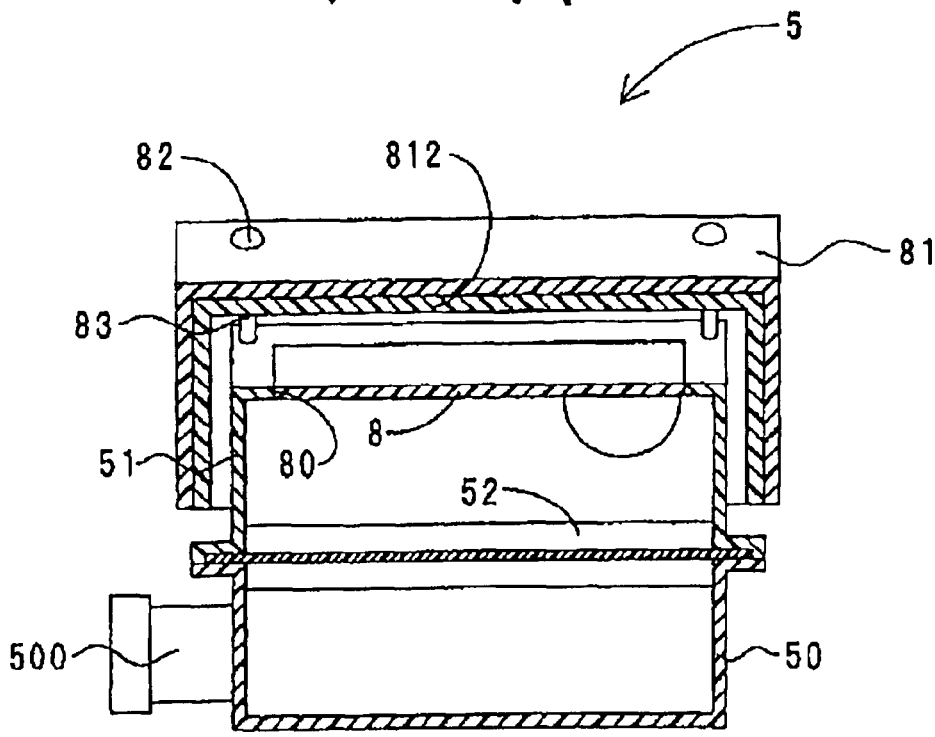
FIG. 12 shows a cross sectional view of the air cleaner incorporated in the air intake apparatus based on the sixth embodiment.

FIG. 12 shows a cross sectional view of the air cleaner incorporated in the air intake apparatus based on this embodiment. The same numerals will be given to parts corresponding to those of FIG. 11. As shown, the noise insulating wall 81 is laminated on the inside of the cup of the noise insulating wall with the non-woven fabric layer 812 made of PET non-woven fabric.

According to this embodiment, the non-woven fabric layer 812 may lower the transmitting noise getting out from the permeable member 8. Thus, the transmitting noise decreasing effect is high.

In the following, explanation will be made to embodiments focusing on the air cleaner of the invention.

(7) Seventh Embodiment

Figure 13:
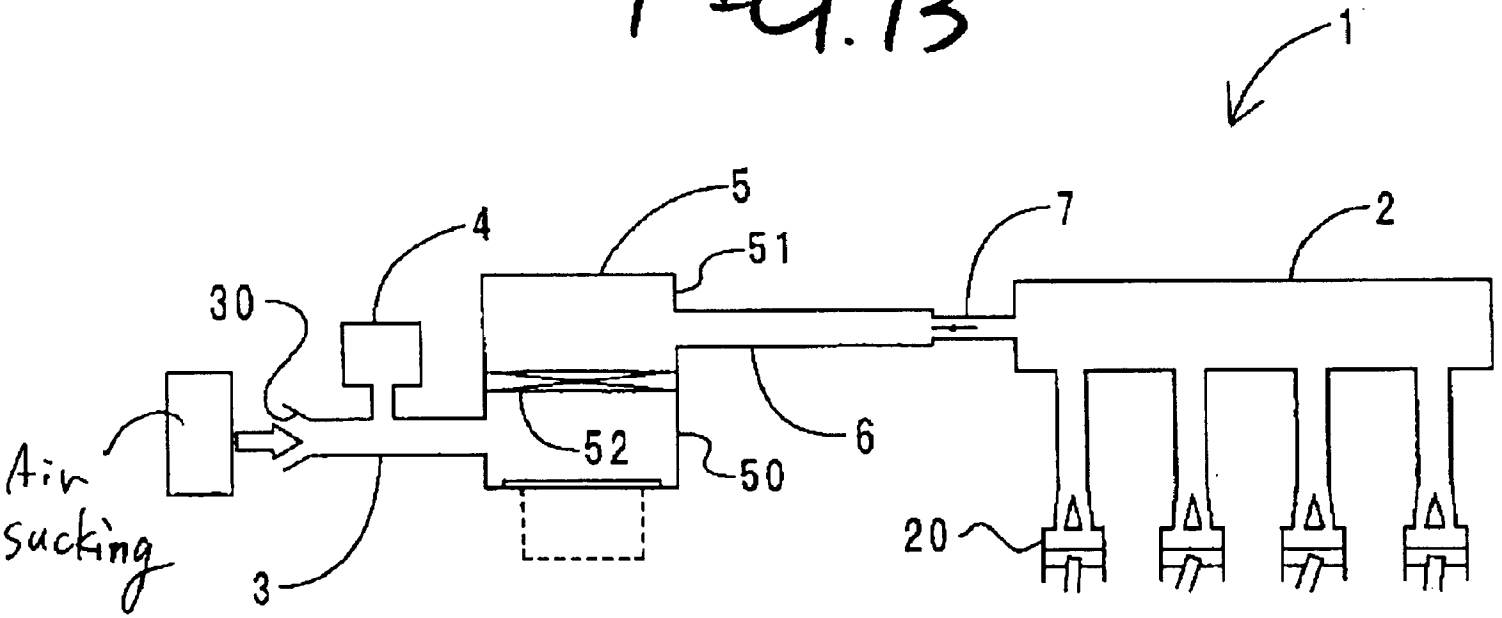
FIG. 13 shows a schematic view of the air intake system incorporated with the air cleaner of the seventh embodiment of the invention.

At first, the air cleaner and the structure of the air intake system incorporated with d the air cleaner will be referred to. A schematic view of the air intake apparatus of the embodiment is shown in FIG. 13. The air cleaner according to the present embodiment can be installed also in that in FIG. 1. As seen in the same, the air intake apparatus 1 comprises the air intake duct 3, the resonator 4, the air cleaner 5, the air cleaner hose 6, the throttle body 7, and the intake manifold 2, which has a similar structure shown in FIG. 1. In the interior of these members, the air intake path 10 from the air intake port 30 to the intake manifold 2 is sectioned.

The intake duct 3 has the same structure as that in FIG. 1.

Figure 14:
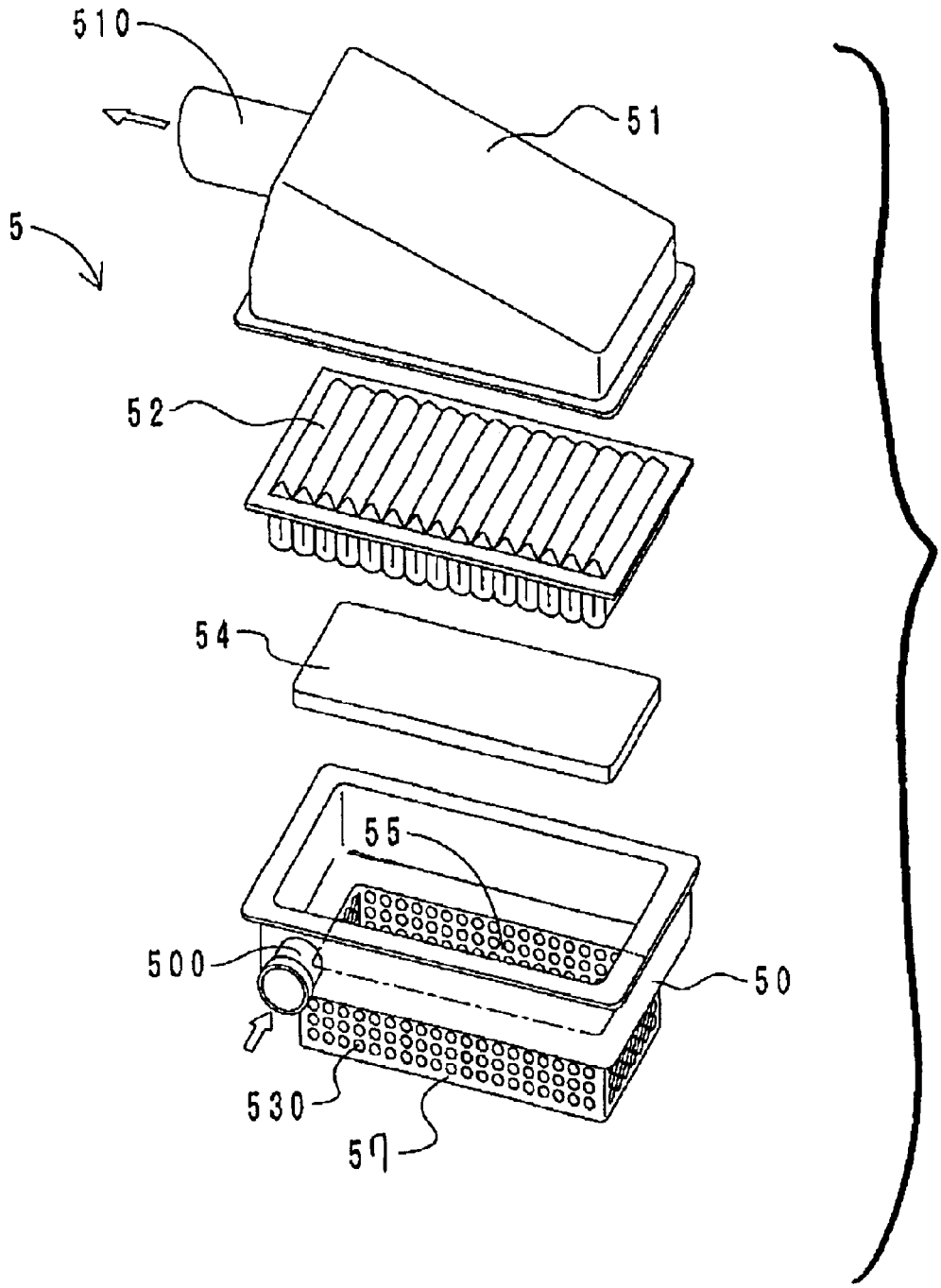
FIG. 14 shows a disassembled view of the air cleaner of the seventh embodiment.

The air cleaner 5 has the dirty side case 50, the clean side case 51, and the element 52. FIG. 14 shows a disassembled view of the air cleaner 5. As shown in the same, the dirty side case 50 is made of the resin, taking the box shape opening upward, and projects a duct connecting cylinder 500 from a side wall 50 thereof, the duct connecting cylinder 500 being connected to the downstream end of the intake duct 3 shown in FIG. 13. A bottom of the dirty side case 50 projects downward. A case wall composing this projecting part is disposed with the noise insulating wall part (noise insulating wall) 57 formed with lots of communicating holes 530. The noise insulating wall part 57 is formed as one body with the dirty side case 50 by an injection molding. Within the noise insulating wall part 57, the compartment room 55 is arranged. On the upper portion of the compartment room 55, the rectangular permeable member 54 made of PET non-woven fabric is connected by fusing. That is, the upper part of the compartment room 55 is closed with the permeable member 54. In other words, the interior of the dirty side case 50 is sectioned by the permeable member 54 into the interior of the compartment room 55 and the exterior of the compartment room 55.

The clean side case 51 is made of the resin, taking the box shape opening downward, mounted on the dirty side case 50 under a condition of turning over the opening, and projects a hose connecting cylinder 510 from a side wall 51 thereof.

The element 52 has the same structure as that in FIG. 2.

Figure 15:
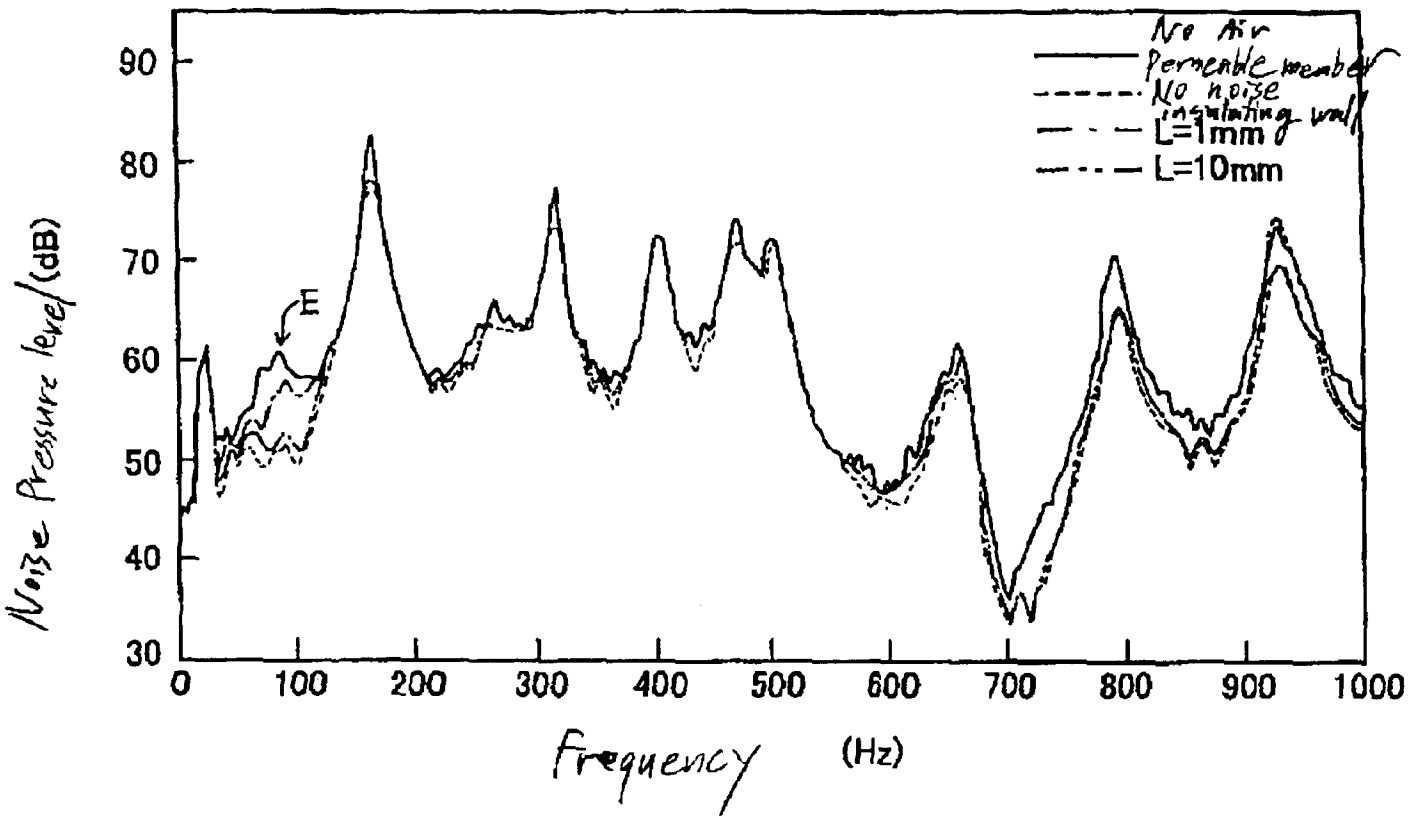
FIG. 15 shows frequency distributions of air suction noises in the air intake system incorporated with the air cleaner of the seventh embodiment.

Next, effects brought about by the air cleaner of the embodiment will be referred to. FIG. 15 shows the frequency distributions without disposing the resonator 4. By the way, the frequency distributions were measured by generating white noises from a speaker placed at the downstream of the intake manifold 2 and collecting the air sucking noise. In the figure, a solid line is the frequency distribution without the permeable member. In the same, a dotted line is the frequency distribution with the only permeable member of thickness t=2 mm and without the noise insulating wall part. One-dotted line is the frequency distribution with having the permeable member of thickness t=2 mm and disposing the noise insulating wall part separated by a separating width L=1 mm from the permeable member. By the way, the separating width is meant by a distance between the lower surface of the permeable member and the upper surface of the permeable member disposed on the bottom wall of the case. Further, two-dotted line is the frequency distribution having the permeable member of thickness t=2 mm and disposing the noise insulating wall part separated by a separating width L=10 mm from the permeable member. In regard to the permeable member, the PET non-woven fabric of raw fabric weight being 840/$m^2$ and the PET non-woven fabric of raw fabric thickness (before a hot-pressing) being 5 mm are subjected to the hot press to change thickness for changing quantity of airflow.

As shown, in the case of L=1 mm, comparing with a case of having the only permeable member and not having the noise insulating wall, the resonance peak E of the low frequency heavy noise is high. In the case of L=10 mm, comparing with the case of having the only permeable member and not having the noise insulating wall, the resonance peak E of the low frequency heavy noise is almost at the same height. From this fact, it is seen that the larger is the distance width L, the larger is the effect of reducing the air sucking noise.

Figure 16:
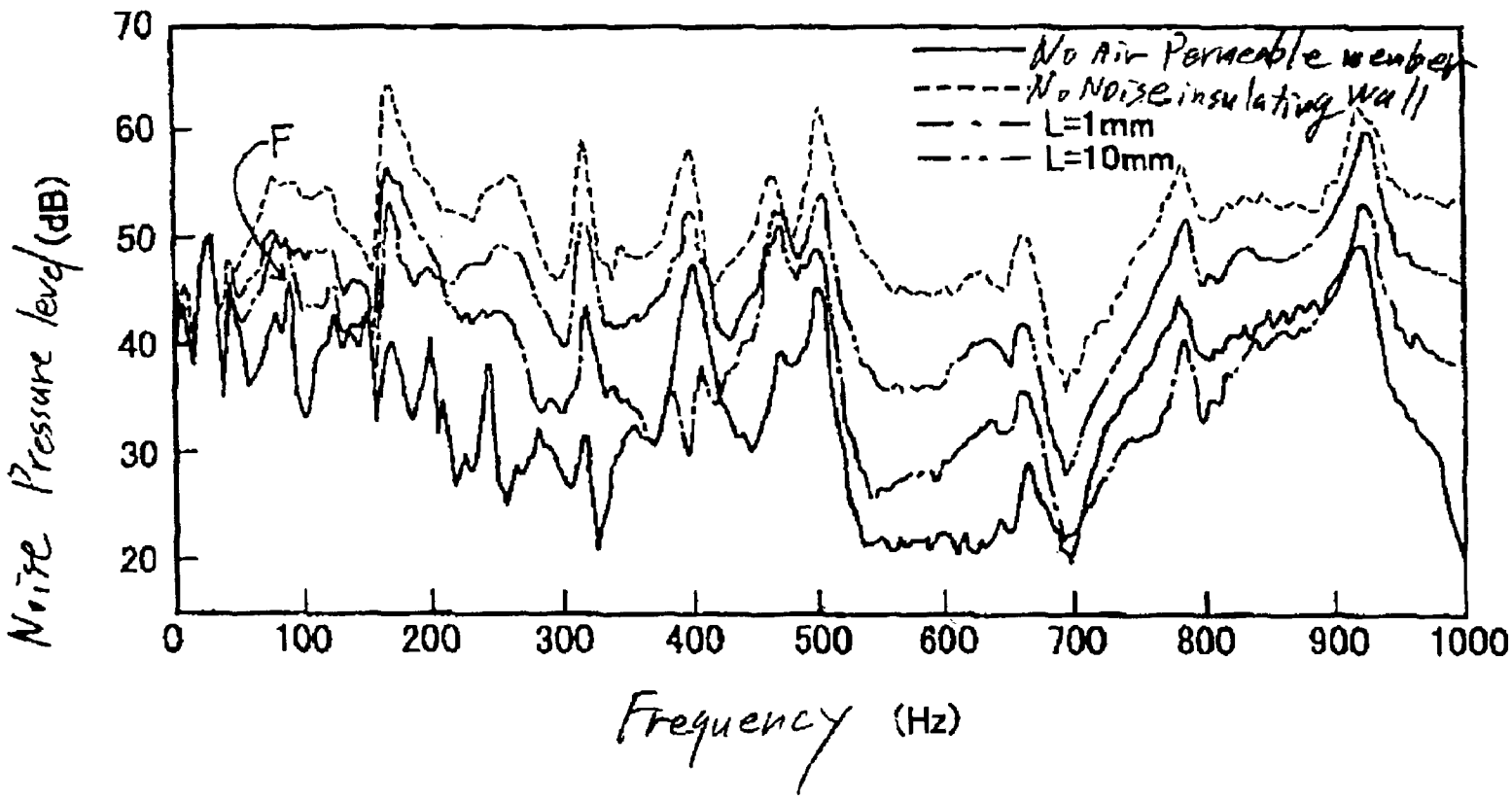
FIG. 16 shows frequency distributions of air transmitting noises in the air intake system incorporated with the air cleaner of the seventh embodiment.

FIG. 16 shows the frequency distributions of the air transmitting noises without arranging the resonator 4 for middle and high frequencies. The transmitting noise is collected by disposing the microphone outside of the noise insulating wall 81. In the figure, the solid line is the frequency distribution without the permeable member. In the same, a dotted line is the frequency distribution with the only permeable member of thickness t=2 mm and without the noise insulating wall. One-dotted line is the frequency distribution with the permeable member of thickness t=2 mm and the noise insulating wall arranged separated by a width L=1 mm from the permeable member. Two-dotted line is the frequency distribution with the permeable member of thickness t=2 mm and the noise insulating wall arranged separated by a width L=10 mm from the permeable member. In regard to the permeable member, the Pet non-woven fabric of raw fabric weight being 840/$m^2$ and the PET non-woven fabric of raw fabric thickness (before a hot-pressing) being 5 mm are subjected to the hot press to change thickness for changing quantity of airflow.

As shown, in the case of L=1 mm, comparing with a case of having the only permeable member and not having the noise insulating wall part, the resonance peak F of the low frequency heavy noise is low by around 5 dB. In the case of L=10 mm, comparing with the case of having the only permeable member and not having the noise insulating wall, the resonance peak F of the low frequency heavy noise is low by around 5 dB. Only, in view of the whole of the frequency distributions, each of the resonance peaks is lower in L=1 mm than L=10 mm. From this fact, it is seen that the smaller is the distance width L, the larger is the effect of reducing the transmitting noise.

From FIGS. 15 and 16, it is seen that with the disposal of the noise insulating wall part, almost equivalent effects of lowering the transmitting noise are brought about in comparison with the case of not disposing the noise insulating wall part but disposing the only permeable member. Further, it is seen that with the disposal of the noise insulating wall part, large effects of lowering the transmitting noise are brought about in comparison with the case of not disposing the noise insulating wall part but disposing the permeable member only. In addition, if changing the separating width L, it is seen that the air suction noise and the transmitting noise may be balanced.

Thus, depending on the air cleaner 5 of this embodiment, not only the air sucking noise but also the transmitting noise can be controlled. By changing the separating width L, the air sucking noise and the transmitting noise may be best balanced. That is, it is sufficient that the separating width L is set at an optimum value, taking, for example, noise interrupting property in the engine room or clog preventing effect of the permeable member into consideration.

According to the air cleaner 5 of this embodiment, the noise insulating wall part 57 is displaced at the dirty side case 50. Therefore, even if dusts invade into the dirty side case 50 through the noise insulating wall part 57 and the permeable member 54, the dusts may be filtered through the element 52, so that the dusts are controlled from invasion in the downstream side after the interior of the clean side case 51.

According to the air cleaner 5 of this embodiment, the noise insulating wall part 57 is formed as one body with the dirty side case 50. Therefore, comparing with a case where the noise insulating wall part 57 is formed independently of the dirty side case 50 or the clean side case 51, parts maybe reduced in number, and production cost may be saved. In addition, the structure of the air cleaner 5 itself is made simple.

(8) Eighth Embodiment

A difference of this embodiment from the seventh embodiment is that the bottom part of the dirty side case does not project. Therefore, this difference will be referred to herein.

Figure 17:
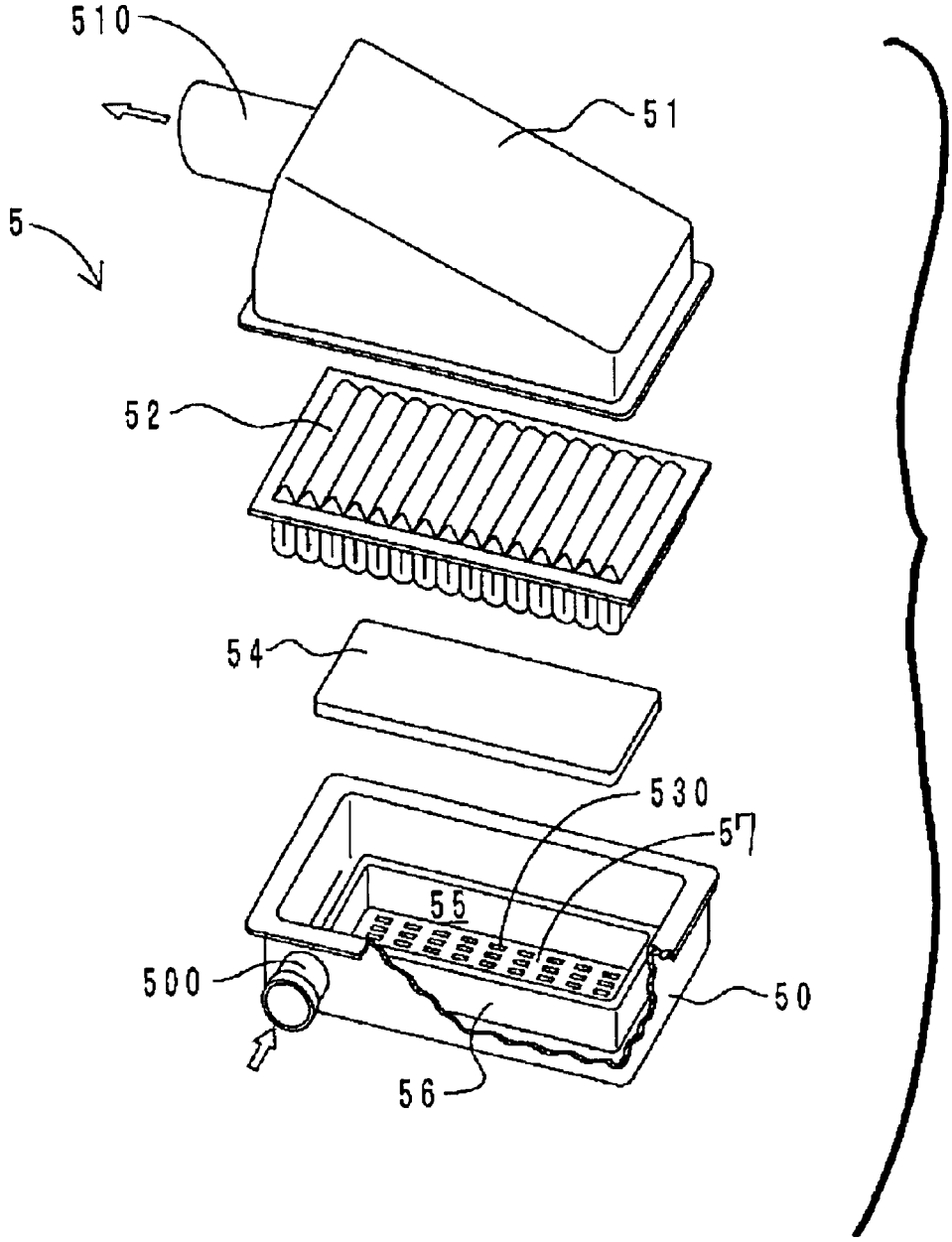
FIG. 17 shows a disassembled view of the air cleaner of the eighth embodiment.

FIG. 17 shows a disassembled view of the air cleaner of this embodiment. The same numerals will be given to parts corresponding to those of FIG. 14. As seen, a partitioning wall 56 stands in rectangle from the bottom wall of the dirty side case 50. The bottom part of the partitioning wall 56 is disposed with the noise insulating wall part (noise insulating wall) 57 formed with slit-like communicating holes 530. On the upper end of the partitioning wall 56, the permeable member 54 is connected by such as fusing. The compartment room 55 is sectioned by the partitioning wall 56 and the permeable member 54. In the embodied air cleaner 5, the bottom part of the dirty side case does not project, so that a space for installing the air cleaner 5 may be small.

(9) Ninth Embodiment

A difference of this embodiment from the seventh embodiment is that the noise insulating wall part is disposed in the clean side case. Therefore, this difference will be referred to herein.

Figure 18:
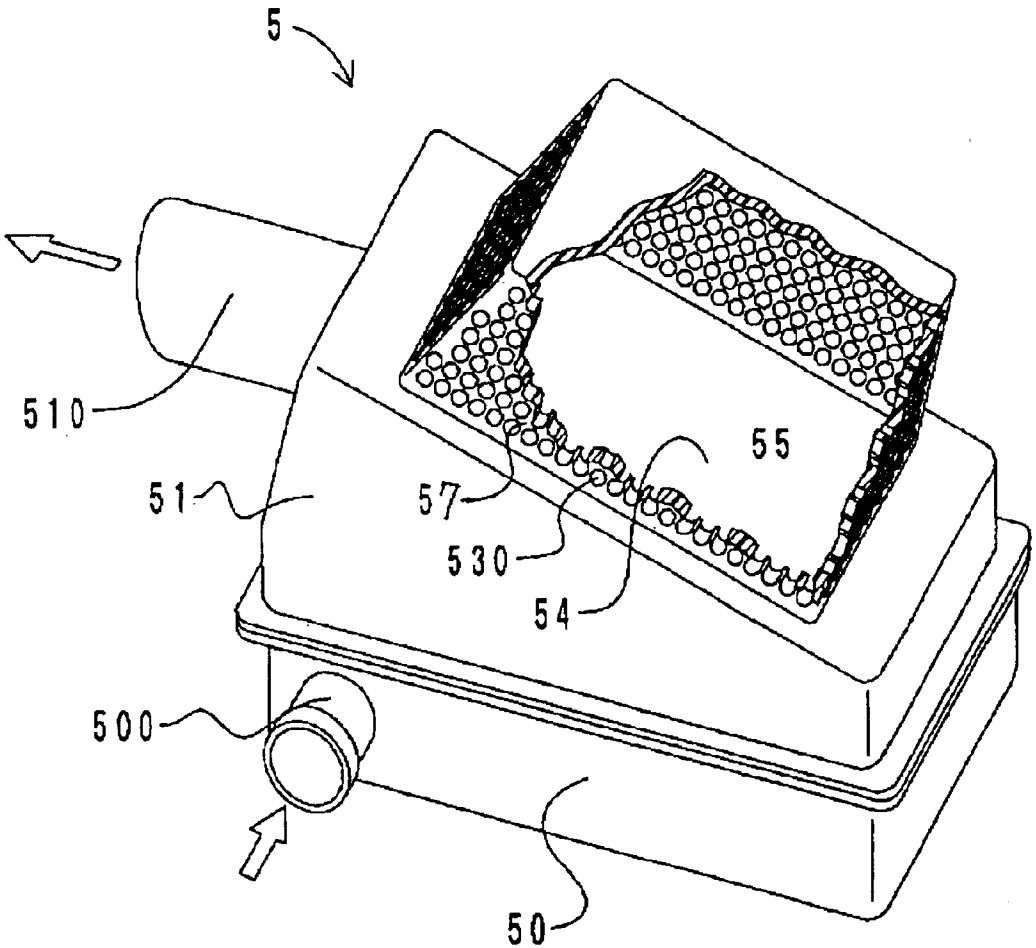
FIG. 18 shows a perspective view of the air cleaner of the ninth embodiment.
Figure 19:
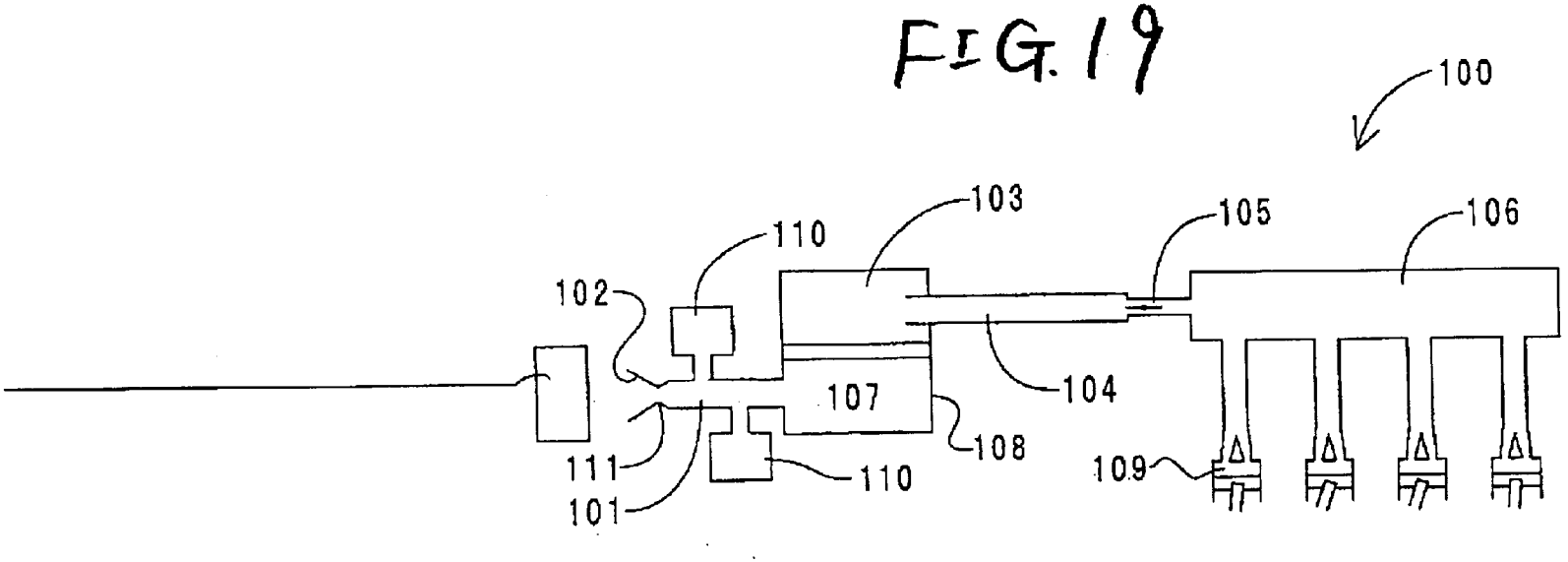
FIG. 19 shows a schematic view of the conventional air intake apparatus.

FIG. 18 shows a perspective view of the air cleaner of this embodiment. The same numerals will be given to parts corresponding to those of FIG. 14. As seen, a top portion of the clean side case 51 projects upward. A case wall composing the projecting portion is disposed with the noise insulating wall part (noise insulating wall) 57 formed with lots of communicating holes 530, the part 57 being formed as one body with the clean side case 51 by the injection molding. The interior of the noise insulating wall part 57 is the compartment room 55. The lower part of the compartment room 55 is connected with the permeable member 54 by such as fusing. That is, the upper portion of the compartment room 55 is closed with the permeable member 54. In other words, the interior of the clean side case 51 is sectioned by the permeable member 54 into the interior of the compartment room 55 and the exterior of the compartment room 55.

Depending on the embodied air cleaner 5, by disposing the noise insulating wall part 57, dusts from the outside of the case may be suppressed from directly adhering the permeable member 54, so that the permeable member 54 is less to be clogged by dusts in the sucked air.

(10) Other

As above mentioned, the explanations have been made to the practiced embodiments of the air intake apparatus and the air cleaner according to the invention. However, embodiments to be reduced to practice are by no means limited to the above mentioned modes, but may be served under various deformations or improved modifications made by those skilled in the technical field.

Figure 21:
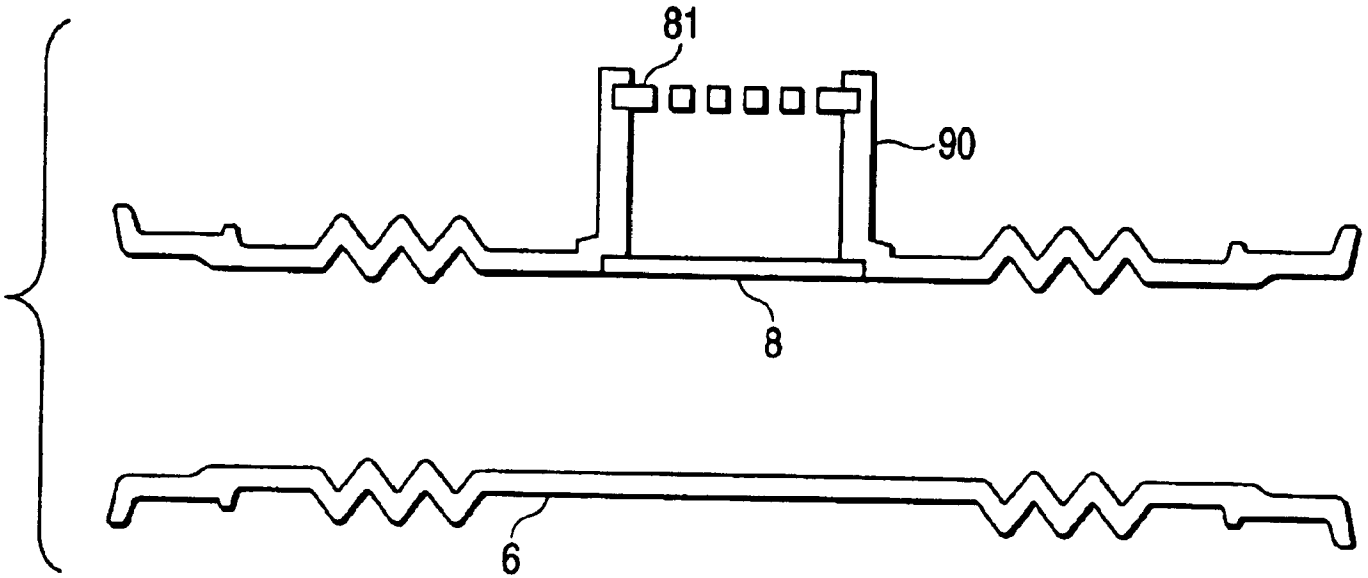
FIG. 21 shows an enlarged view of the air cleaner hose where the permeable member is attached on the hose.

For example, in the above embodiments, the permeable member is disposed in the vicinity of the downstream of the air cleaner or the intake duct. However, in case other members correspond to the antinode region of the resonance mode of the standing wave, the permeable member may be arranged at, e.g., other members such as the air cleaner hose. FIG. 21 shows an enlarged view of the air cleaner hose 6 where the permeable member 8 is attached on the hose 6. For example, the permeable member 8 is integrally molded with the air cleaner hose 6 by insertion molding. The noise insulating wall 81 is attached to a noise insulating wall support member 90 formed on the hose 6.

In addition, in the above embodiments, the single permeable member is disposed in the vicinity of the downstream of the air cleaner or the intake duct. However, a plurality of permeable members may be arranged in combination.

Further, in the above embodiments, the permeable member made of PET non-woven fabric is arranged. But, such permeable members are available as PP non-woven fabric, filter paper, or foaming resins as polyurethane foamed substance, polyethylene foamed substance, or polyvinylchloride foamed substance. In the third embodiment, if the air cleaner is mounted on the upper face of the cylinder head of the engine, the upper wall of the cylinder head may be utilized as the noise insulating wall. Then, the members are reduced in number.

In addition, the position, the number, or the shape of the communicating holes 530 are not especially limited in the noise insulating wall part 57. Only, desirably, the communicating holes 530 are disposed at the side wall part of the noise insulating wall part 57. The communicating holes 530 may be made by forming at the same time as the noise insulating wall part 53, or may be made by boring process in the formed noise insulating wall part 57.

It is preferable to determine the total air flow rate passing the communicating holes 530 to be larger than that passing the permeable member 54. The noise insulating wall part 57 may be set at both of the dirty side case 50 and the clean side case 51.

In addition, although the aforementioned various embodiments are explained independently, characteristics of each embodiment may be combined as freely as possible.

According to the invention, it is possible to offer the intake apparatus enabling miniaturization, to secure the desired engine output, and to suppress the noise. In accordance with the invention, it is possible to provide such an air cleaner, enabling to suppress not only air suction noise but also air transmitting noise and decrease the number of parts.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. An air intake apparatus comprising:

an air intake duct including an air intake port and adapted for communicating the air intake port with an engine combustion chamber;

an opening in communication with an environment external to the air intake duct for suppressing noise emitted from the air intake port, said opening being formed in a wall of the air intake duct and being provided either at a part of said wall of the air intake duct corresponding to a resonance mode antinode of a standing wave in the air intake duct or in a portion of the air intake duct having a high noise pressure level;

a permeable member closing said opening; and a noise insulating wall disposed outside the permeable member for suppressing emission of transmitting noise passing through the permeable member.

2. An air intake apparatus according to claim 1, wherein the permeable member comprises a woven fabric permeable member.

3. An air intake apparatus according to claim 1, wherein the permeable member comprises a non-woven fabric permeable member.

4. An air intake apparatus comprising:

an air intake duct including an air intake port and adapted for communicating the air intake port with an engine combustion chamber;

an opening in communication with an environment external to the air intake duct for suppressing noise emitted from the air intake port, the opening being formed in a wall of the air intake duct at a location that is downstream from the air intake port;

a permeable member closing the opening; and a noise insulating wall disposed outside the permeable member for suppressing emission of transmitting noise passing through the permeable member.

* * * * *